United States Patent [19]

Takebe

[11] Patent Number: 4,575,832

[45] Date of Patent: Mar. 11, 1986

[54] DEVICE FOR TIMEPIECE ELECTRONICALLY SIGNALLING A TIME BY MELODY SOUNDS AND TIME STRIKING SOUNDS

[75] Inventor: Katsuhiko Takebe, Tokyo, Japan

[73] Assignee: Rhythm Watch Co., Ltd., Tokyo, Japan

[21] Appl. No.: 455,835

[22] Filed: Jan. 5, 1983

[30] Foreign Application Priority Data

Jan. 9, 1982 [JP] Japan ..... 57-1979

[51] Int. Cl.[4] ..... G04B 37/00

[52] U.S. Cl. ..... 368/272; 368/273

[58] Field of Search ..... 368/272–273, 368/271; 84/1.03

[56] References Cited

U.S. PATENT DOCUMENTS 4,240,318 12/1980 Gross ..... 84/1.03
4,271,495 6/1981 Scherzinger et al. ..... 81/1.03
4,323,955 4/1982 Chiu ..... 368/273
4,326,276 4/1982 Scott, Jr. ..... 84/1.03
4,328,731 5/1982 Gotho et al. ..... 84/1.01

*Primary Examiner*—Bernard Roskoski
*Attorney, Agent, or Firm*—Koda and Androlia

[57] ABSTRACT

A time signalling device for a timepiece in which the time signalling sound can be obtained in the same signalling sound with the mechanical time signalling means in which the previously produced sound remains to mix with the next sound, and the time signalling sounds in accordance with the more mechanical time signalling means can be electronically produced with good quality by having musical scale signal outputting means which simultaneously provides two musical scale analog signals of the melody sounds with the basis of two kinds of musical data read out of the ROM, by composing in such a way that each of these two musical scale analog signals can be alternatively output from these musical scale signal outputting means, by attenuating each of the output musical note signals for longer while than the time when the next musical note is produced, and, for the time striking sounds, by simultaneously outputting these two musical scale signals to be mixed.

7 Claims, 17 Drawing Figures

TIME STRIKING NUMBER DETECTOR
28
24
36
38
C
G
E
S
H
X
A1
A2
A3
A4
78
80
88-1
88-2
88-3
88-4
90-1
90-2
90-3
90-4
92-1
92-2
92-3
92-4
94-1
94-2
94-3
94-4
96
98
100
102
104
106

| |
|---|
| MELODY A TEMPO DATA |
| MELODY A RIGHT HOUR |
| TIME STRIKING COMMENCEMENT JUMP DATA |
| FINAL TIME STRIKING SOUND TEMPO DATA |
| FINAL TIME STRIKING SOUND DATA |
| TIME STRIKING COMPLETION DATA |
| MELODY A TEMPO DATA |
| MELODY A 15 MINUTES |
| TIME SIGNALLING COMPLETION DATA |
| MELODY A TEMPO DATA |
| MELODY A 30 MINUTES |
| TIME SIGNALLING COMPLETION DATA |
| MELODY A TEMPO DATA |
| MELODY A 45 MINUTES |
| TIME SIGNALLING COMPLETION DATA |
| MELODY B TEMPO DATA |
| MELODY B RIGHT HOUR |
| TIME STRIKING COMMENCEMENT JUMP DATA |
| FINAL TIME STRIKING SOUND TEMPO DATA |
| FINAL TIME STRIKING SOUND DATA |
| TIME STRIKING COMPLETION DATA |
| MELODY B TEMPO DATA |
| MELODY B 15 MINUTES |
| TIME SIGNALLING COMPLETION DATA |
| MELODY B TEMPO DATA |
| |

| |
|---|
| MELODY B 30 MINUTES |
| TIME SIGNALLING COMPLETION DATA |
| MELODY B TEMPO DATA |
| MELODY B 45 MINUTES |
| TIME SIGNALLING COMPLETION DATA |
| MELODY C TEMPO DATA |
| MELODY C RIGHT HOUR |
| TIME STRIKING COMMENCEMENT JUMP DATA |
| FINAL TIME STRIKING SOUND TEMPO DATA |
| FINAL TIME STRIKING SOUND DATA |
| TIME STRIKING COMPLETION DATA |
| MELODY C TEMPO DATA |
| MELODY C 15 MINUTES |
| TIME SIGNALLING COMPLETION DATA |
| MELODY C TEMPO DATA |
| MELODY C 30 MINUTES |
| TIME SIGNALLING COMPLETION DATA |
| MELODY C TEMPO DATA |
| MELODY C 45 MINUTES |
| TIME SIGNALLING COMPLETION DATA |
| |
| TIME STRIKING SOUND TEMPO DATA |
| TIME STRIKING SOUND DATA |
| TIME STRIKING CYCLE JUMP DATA |
| |

FIG. 5

RIGHT HOUR

| NO | $M_1$ | $M_2$ | $M_3$ | $M_4$ | $M_5$ | $M_6$ | $M_7$ | $M_8$ | $M_9$ | $M_{10}$ | $M_{11}$ | $M_{12}$ | $M_{13}$ | $M_{14}$ | $M_{15}$ | $M_{16}$ |
|---|---|---|---|---|---|---|---|---|---|---|---|---|---|---|---|---|
| 1 | X | X | X | X | X | H | X | TEMPO DATA | | | | X | TEMPO | | | |
| 2 | MUSICAL NOTE LENGTH | | ♩ | H | L | H | L | $C_3$ | | | | | | | | L |
| 3 | ↑ | | ♩ | L | H | H | H | ↑ | | | | $E_3$ | | | | L |
| 4 | ↑ | | ♩ | H | L | H | H | $D_3$ | | | | ↑ | | | | L |
| 5 | ↑ | | 𝅗𝅥 | L | H | L | L | ↑ | | | | $G_2$ | | | | L |
| 6 | ↑ | | ♩ | H | L | H | L | $C_3$ | | | | ↑ | | | | L |
| 7 | ↑ | | ♩ | L | H | H | H | ↑ | | | | $D_3$ | | | | L |
| 8 | ↑ | | ♩ | H | L | H | H | $E_3$ | | | | ↑ | | | | L |
| 9 | ↑ | | 𝅗𝅥. | L | H | H | H | ↑ | | | | $C_3$ | | | | L |
| 10 | ↑ | | ♩ | H | L | H | H | ↑ | | | | ↑ | | | | L |
| 11 | ↑ | | ♩ | L | H | H | H | ↑ | | | | ↑ | | | | L |
| 12 | ↑ | | ♩ | H | L | H | H | $D_3$ | | | | ↑ | | | | L |
| 13 | ↑ | | 𝅗𝅥 | L | H | L | L | ↑ | | | | $G_2$ | | | | L |
| 14 | ↑ | | ♩ | H | L | L | L | $G_2$ | | | | ↑ | | | | L |
| 15 | ↑ | | ♩ | L | H | L | H | ↑ | | | | $D_3$ | | | | L |
| 16 | ↑ | | ♩ | H | L | H | H | $E_3$ | | | | ↑ | | | | L |
| 17 | ↑ | | 𝅗𝅥. | L | H | H | H | ↑ | | | | $C_3$ | | | | L |
| 18 | X | X | X | JAMP ADDRESS | | | | | | | | X | TIME STRIKING COMMENCEMENT | | | |
| 19 | X | X | X | X | X | H | X | TEMPO DATA | | | | X | TEMPO | | | |
| 20 | MUSICAL NOTE LENGTH | | 𝅝 | H | H | L | L | $C_3$ | | | | $G_2$ | | | | L |
| 21 | ↑ | | 𝅝 | L | L | H | L | ↑ | | | | ↑ | | | | L |
| 22 | X | X | X | X | X | X | X | X | X | X | X | X | E N D | | | |

FIG. 6-1

15 MINUTES

| | | | | | | | | | | | | | | |
|---|---|---|---|---|---|---|---|---|---|---|---|---|---|---|
| 23 | X | X | X | X | X | H | X | TEMPO DATA | | | | X | TEMPO | |
| 24 | MUSICAL NOTE LENGTH | | ♩ | H | L | H | L | $E_3$ | | | | | | L |
| 25 | ↑ | | ♩ | L | H | H | H | ↑ | | | | $D_3$ | | L |
| 26 | ↑ | | ♩ | H | L | H | H | $C_3$ | | | | ↑ | | L |
| 27 | ↑ | | 𝅗𝅥 | L | H | H | L | ↑ | | | | $G_2$ | | L |
| 28 | ↑ | | 𝅗𝅥. | L | L | H | L | ↑ | | | | ↑ | | L |
| 29 | X | X | X | X | X | X | X | X | X | X | X | X | E N D | |

30 MINUTES

| | | | | | | | | | | | | | | |
|---|---|---|---|---|---|---|---|---|---|---|---|---|---|---|
| 30 | X | X | X | X | X | X | X | TEMPO DATA | | | | X | TEMPO | |
| 31 | MUSICAL NOTE LENGTH | | ♩ | H | L | H | L | $C_3$ | | | | | | L |
| 32 | ↑ | | ♩ | L | H | H | H | ↑ | | | | $E_3$ | | L |
| 33 | ↑ | | ♩ | H | L | H | H | $D_3$ | | | | ↑ | | L |
| 34 | ↑ | | 𝅗𝅥 | L | H | H | L | ↑ | | | | $G_2$ | | L |
| 35 | ↑ | | ♩ | H | L | H | L | $C_3$ | | | | ↑ | | L |
| 36 | ↑ | | ♩ | L | H | H | H | ↑ | | | | $D_3$ | | L |
| 37 | ↑ | | ♩ | H | L | H | H | $E_3$ | | | | ↑ | | L |
| 38 | ↑ | | 𝅗𝅥 | L | H | H | H | ↑ | | | | $C_3$ | | L |
| 39 | ↑ | | 𝅗𝅥. | L | L | H | H | ↑ | | | | ↑ | | L |
| 40 | X | X | X | X | X | X | X | X | X | X | X | X | E N D | |

FIG. 6-2

45 MINUTES

| | | | | | | | | | | | | | |
|---|---|---|---|---|---|---|---|---|---|---|---|---|---|
| 41 | X | X | X | X | X | H | X | TEMPO DATA | | | X | TEMPO | |
| 42 | MUSICAL NOTE LENGTH | | ♩ | H | L | H | L | $E_3$ | | | | | L |
| 43 | ↑ | | ♩ | L | H | H | H | ↑ | | | $C_3$ | | L |
| 44 | ↑ | | ♩ | H | L | H | H | $D_3$ | | | ↑ | | L |
| 45 | ↑ | | 𝅗𝅥 | L | H | H | L | ↑ | | | $G_2$ | | L |
| 46 | ↑ | | ♩ | H | L | L | L | $G_2$ | | | ↑ | | L |
| 47 | ↑ | | ♩ | L | H | L | H | ↑ | | | $D_3$ | | L |
| 48 | ↑ | | ♩ | H | L | H | H | $E_3$ | | | ↑ | | L |
| 49 | ↑ | | 𝅗𝅥 | L | H | H | H | ↑ | | | $C_3$ | | L |
| 50 | ↑ | | ♩ | H | L | H | H | ↑ | | | ↑ | | L |
| 51 | ↑ | | ♩ | L | H | H | H | ↑ | | | $D_3$ | | L |
| 52 | ↑ | | ♩ | H | L | H | H | $C_3$ | | | ↑ | | L |
| 53 | ↑ | | 𝅝 | L | H | L | L | ↑ | | | $G_2$ | | L |
| 54 | ↑ | | ♩ | L | L | H | L | ↑ | | | ↑ | | L |
| 55 | X | X | X | X | X | X | X | X | X | X | X | X | END |

TIME STRIKING SOUND

| | | | | | | | | | | | |
|---|---|---|---|---|---|---|---|---|---|---|---|
| 56 | X | X | X | X | X | X | X | TEMPO DATA | | X | TEMPO |
| 57 | MUSICAL NOTE LENGTH | | 𝅗𝅥. | H | H | L | L | $C_3$ | $G_2$ | | L |
| 58 | X | X | X | JAMP ADDRESS | | | | | | X | TIME STRIKING CYCLE |

FIG. 6-3

DEVICE FOR TIMEPIECE ELECTRONICALLY SIGNALLING A TIME BY MELODY SOUNDS AND TIME STRIKING SOUNDS

BACKGROUND OF THE INVENTION

1. Field of The Invention

The present invention relates to a time signalling device for a timepiece, and more particularly to a time signalling device for a timepiece electronically generating melody sounds or time striking sounds with excellent tone at every right hour and furthermore generating melody sounds or time striking sounds at every 15 minutes after the right hour in case of neccesity.

2. Description of Prior Art

There has been well-known time signalling device generating predetermined time striking sounds at a right hour or a half hour and furthermore generating melody sounds independently or prior to the time striking sounds at the right hour and every quarter hour, and there is a good example of westminster clock in practical use. This type of conventional time signalling device is composed with the mechanical time signalling device generating melody sounds or time striking sounds by means of striking stick bells in predetermined order to produce a plurality of different sounds, and causes the drawbacks of large and complicated structure. According as recent electronization of timepiece, to the time signalling device is applied the electronic sound generating means, and the data of musical notes generated by means of stick bells are memorized in a ROM in a predetermined order so that the sounds can be generated in such order in a similar tone to the sounds produced by the mechanical time signalling device mentioned above by means of reading such data. The such kind of the electronic time signalling device in the prior art generated the melody sounds with much worse tone in comparison with the tone produced by the mechanical time signalling device. It is because in the mechanical time signalling device the struck sound of a stick bell still remains after the next stick bell is struck by a hammer whereas in the electrinic time signalling device the data of the musical notes are output from the ROM in the predetermined order and the previous sounds do not remain. In other cases, the time striking sounds are produced by hammering a plurality of sick bells at the same time in the mechanical time signalling device, but the electronic time signalling device generates only one sound at one time.

The conventional electronic time signalling device has never been considered counter measure for the above mentioned points.

SUMMARY OF THE INVENTION

Accordingly, it is a general object of the present invention to provide an electronic time signalling device for a timepiece which can generate electronic sounds similar to the time signalling sounds produced by a more mechanical time signalling device with excellent tone.

In keeping with the principles of the present invention, the object is accomplished with an electronic time signalling device having two pieces of musical scale signal generating means which output the musical scale signal of an individual musical note of a melody, either one of which outputs the musical scale signal of the individual musical note consisting of the melody and the other one of which outputs the musical scale signal of the succeeding musical note of the melody before the previous musical scale signal completes its reduction, and which repeat the above mentioned actions in alternating way, and furthermore, in case of time striking sounds, two pieces of which can generate two musical scale signals at the same time.

BRIEF DESCRIPTION OF DRAWINGS

The above mentioned features and object of the present invention will become more apparent by reference to the following description in conjunction with the accompanying drawings, wherein like referenced numbers denote like elements, and in which:

FIG. 5 is an illustration describing memorized contents of ROM of FIG. 4;

FIGS. 6-1, 6-2, 6-3 are illustrations describing memorized contents of ROM in case of memorizing one melody;

FIGS. 12-1, 12-2 are timing charts showing the time signalling action at the right hour in FIG. 1.

DETAILED DESCRIPTION OF THE EMBODIMENTS

Figure 1:
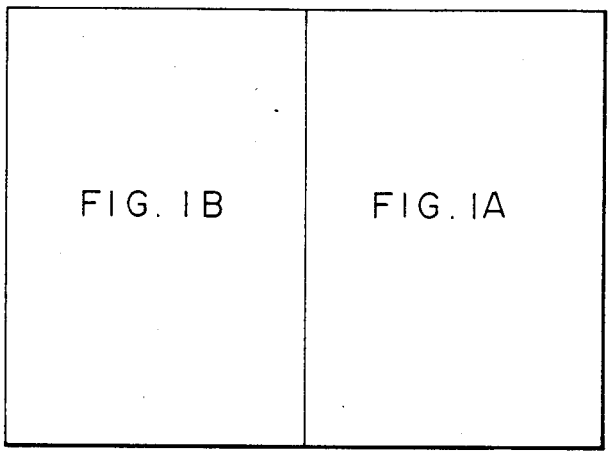
Figure 1A:
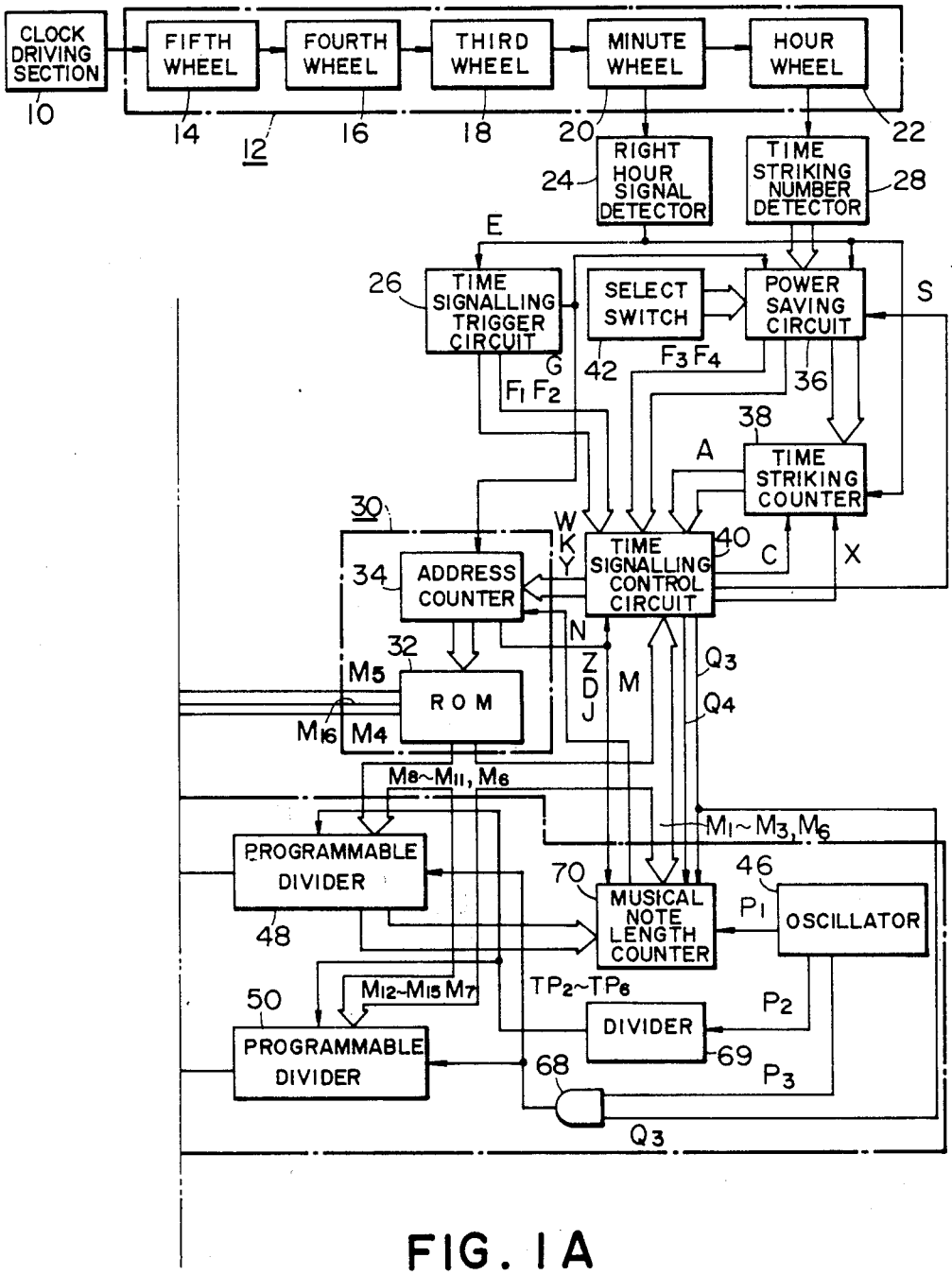
FIGS. 1A, 1B is a block diagram showing a preferred embodiment of the time signalling device for timepiece in accordance with the teachings of the present invention.
Figure 1B:
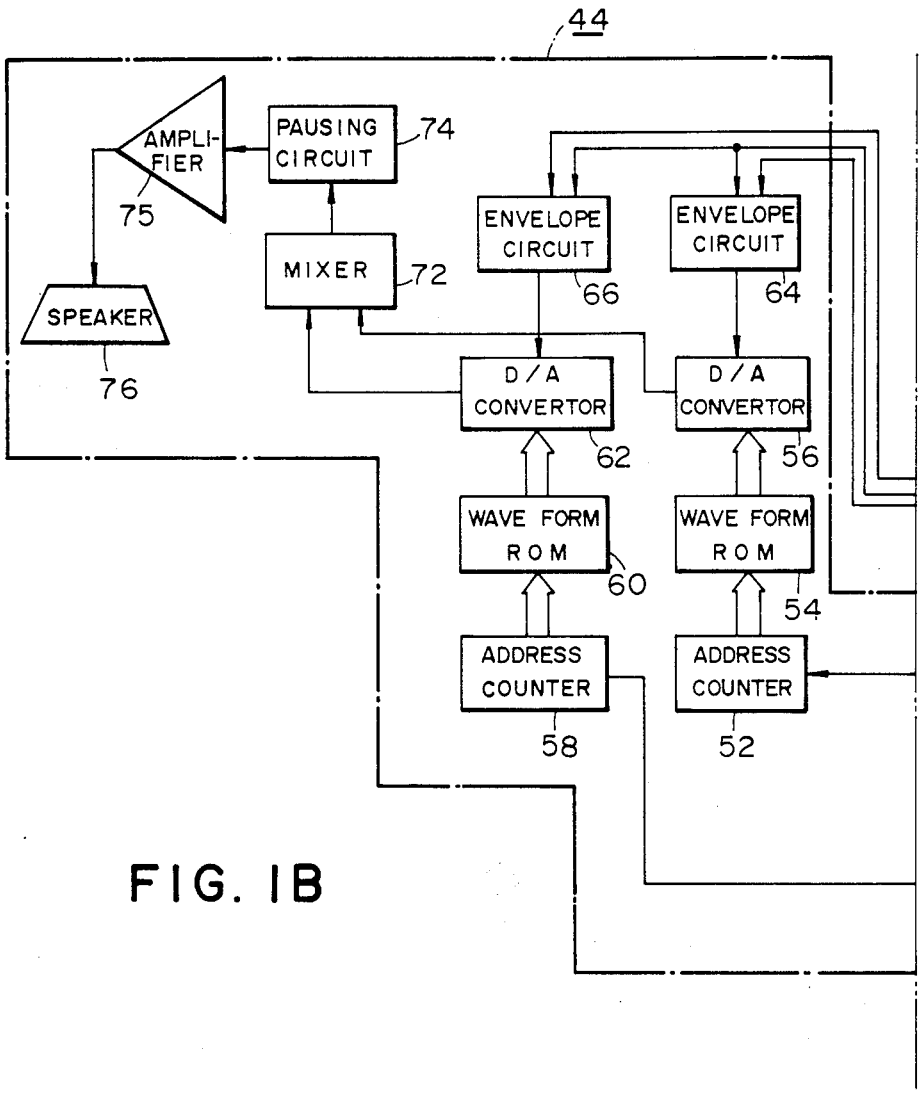

Referring more particularly to the drawings, shown in FIG. 1 is an entire block diagram of the time signalling device for timepiece in accordance with the teachings of the present invention. From a clock driving section 10 including crystal oscillator, etc., constant rotation is output as rotative driving force of pulse motor, etc. with accurate control of the crystal oscillator. The rotative driving power from the clock driving section 10 is transferred to time indicating gear train 12 to perform analog type time display by rotation of an hour hand. In the time indicating gear train 12 installed therein are the fifth wheel 14, the fourth wheel 16, the tird wheel 18, the minute wheel 20 and the hour wheel 22, and the time is displayed by the second hand, the minute hand and the hour hand, which are not illustrated, respectively fixed to the fourth wheel 16, the minute wheel 20 and the hour wheel 22.

In order to produce the melody sounds and the time striking sounds to be synchronized with an indicating time of timepiece there is installed a right hour signal detector 24 in the present invention which electrically detects the right hour signal at the indicated time of a right hour and which has a right hour detecting contact installed in the time indicating gear train 12. In the embodiment, the right hour detecting contact is installed with correspondence to the minute wheel 20 to detect the right hour signal E by the ON operation of the right hour detecting contact at an indicating time of the right hour. The right hour signal E of the right hour signal detector 24 issupplied to a time signalling trigger circuit 26 to output the time signalling trigger signal G and the time signalling sound directing signals $F_1$ and $F_2$ at a requested signalling time with the basis of the right hour signal E. The time signalling trigger circuit 26 in the embodiment is consisted of 45 minute counter to output the above mentioned signal G, $F_1$ and $F_2$ at the interval of 15 minutes from the right hour, that is, "15 minutes", "30 minutes" and "45 minutes". The right hour signal detector 24 and the time signalling trigger circuit 26 compose a time detector which detects a predetermined time.

On the other hand, there is installed a time striking number detector 28 in order to detect the time striking numbers at the indicating time of the right hour and the half hour. The time striking number detector 28 has a sliding contact installed in the time indicating gear train 12 (the hour wheel 22 in the embodiment) and electrically detects the time striking numbers corresponding to an indicated time of timepiece. The sliding contact in the embodiment is not illustrated in the drawings but it is conposed of a contact disc having plural groups of contact points facingly installed to the hour wheel 22 so that the time striking numbers are detected by ON-OFF action of each group of the contact points corresponding to the rotated position of the hour wheel 22.

In order to select the time signalling sound corresponding to each time signalling occasion with the basis of the above mentioned time signalling trigger signal G, there is a time signalling sound selecting circuit 30 which includes a ROM (Read on Memory) 32 and an address counter 34. The ROM 32 in the present invention consists of digital memory and memorizes melody sound tempo data and melody sound data which accompany time signalling completion data, final time striking sound tempo data and final time striking sound data which accompany time striking commencement jump data and time striking completion data, and time striking sound tempo data and time striking sound data which accompany time striking cycle jump data. The address counter 34 performs addressing action which reads the melody sound data and the time striking sound data corresponding to each signalling time out of the ROM 32.

The time signalling number signal of the above mentioned time signalling number detector 28 is supplied to the time striking counter 38 by way of a power saving circuit 36 to determine the time striking numbers in the time striking counter 38 on the basis of the time striking number signal. The determined number in the time striking counter 38 are reduced every time striking and the time striking completion signal A is output upon completion of time striking numbers.

The time signalling sound selecting action of the above mentioned time signalling sound selecting circuit 30 is controlled by a time signalling control circuit 40 which outputs the requested melody sound data read out signals to the time signalling sound selecting circuit 30 in accordance with the time signalling sound directing signals $F_1$ and $F_2$ of the time signalling trigger circuit 26, and which completes the time signalling action by the time signalling completion data of the ROM 32, during which the time signalling control circuit 40 controls the predetermined melody sound selecting action of the time signalling sound selecting circuit 30. The time signalling control circuit 40 also supplies the time striking sound data read out signal to the time signalling sound selecting circuit 30 by means of the time striking commencement jump data and the time striking cycle jump data of the ROM 32, and further completes the time signalling action by the time striking completion signal A of the time striking counter 38, during which the time signalling control circuit 40 controls the time striking sound selecting action of the time signalling sound selecting circuit 30. In FIG. 1 the melody sound data read out signal and the time striking sound data read out signal are shown as control program signal Y, and the time signalling completion data, the time striking commencement jump data and the time striking cycle jump data of the ROM 32 are shown as a ROM program signal M of the ROM 32.

In the embodiment, when the time striking action is not required, the power saving circuit 36 can void the time striking counter 38 to reduce the consumption of time striking electric power. In the above mentioned ROM 32, the melody sound data are memorized in plurality and the time signalling melody can be selected by the users' preference by a select switch 42. The melody selecting action is performed by the supply of the melody select signals $F_3$ and $F_4$ of the time signalling control circuit 40.

The select signal of the time signalling sound selecting circuit is supplied to a sound generator 44 as a ROM program signal M to perform sound producing action of requested time signalling which includes the melody sounds and the time striking sounds. The sound generator 44 includes an oscillator 46 outputting basic sound signals $P_1$, $P_2$ and $P_3$ which have basic frequencies required in order to synthesize the time signalling sounds, and the basic sound signal $P_3$ is divided into the frequencies addressed by the ROM program signals $M_6$ through $M_{15}$ in a programmable divider 48 to be changed into the requested signal of musical scale. The signal of musical notes from the programmable divider 48 is converted into the analog musical scale signal by a musical note address counter 52, a waveform ROM 54 and a D/A converter 56. The signal of musical scale from the programmable divider 50 is converted into the analog musical note signal by a musical note address counter 58, a waveform ROM 60 and a D/A converter 62. To the power supply terminal of the D/A converter 56 is connected an envelope circuit 64 and to the power supply terminal of the D/A converter 62 is connected an envelope circuit 66. The oscillator 46, the programmable dividers 48 and 50, the musical note address counters 52 and 58, the waveform ROM's 54 and 60, and the D/A converters 64 and 66 compose a musical scale signal generator which outputs the analog waveform signals having two musical scale frequencies by means of two musical scale data from the ROM 32.

Whenever the musical note signal is output from the programmable divider 48 and the programmable divider 50 by the supply of the signals $M_4$, $M_5$ and $M_{16}$ from the ROM 32, the envelope circuits 64 and 66 become valid alternatively for melody sounds and simultaneously for time striking sounds, and each of the musical note signals is output alternatively for melody sounds and simultaneously for time striking sounds from the D/A converters 56 and 62. The analog musical note signal is provided vibratos by a divider 69. The signal of musical scale is further provided envelope attenuating action by the envelope circuits 64 and 66 and the analog musical note signal is obtained with good quality of similarity to the signalling sound produced by the conventional mechanical stick bells. The basic sound signal $P_3$ from the oscillator 46 is supplied to the programmable dividers 48 and 50 by way of an AND gate 68, which is composed so that it is put in the open state by the signal from the time signalling control circuit 40 to supply the basic sound signal $P_3$ to the programmable dividers 48 and 50 only when the melody sound data and the time striking sound data are read out of the ROM 32. The signalling length of the musical notes is determined by a musical note length counter 70 controlled by the ROM program signals $M_1$ through $M_3$ and the signals $TP_2$ through $TP_6$, and the signalling length of the analog musical note length signal is decided by the supply of musical note length signal N to the address counter 34. The analog musical note signal which is the output of the D/A converter 56 and 62 is mixed by a mixer 72 to be supplied to an amplifier 75 by way of a pausing circuit 74 of the time signalling, and the time signalling action is performed through the speaker 76 after the determined amplifying action. The pausing circuit 74 of the time signalling is to void the time signalling action during sleep at night and to prevent the analog musical note signals from conducting to the amplifier 75 between the predetermined times.

The musical note count up singal N of the above mentioned musical note length counter 70 is supplied to the address counter 34 and used as count trigger signals to advance the melody sound data of the ROM 32 one after another.

The composition of the present invention is evident from the description made in the above and a further detailed composition of each portion is described hereinafter on the basis of FIGS. 2 through 10.

Figure 2:
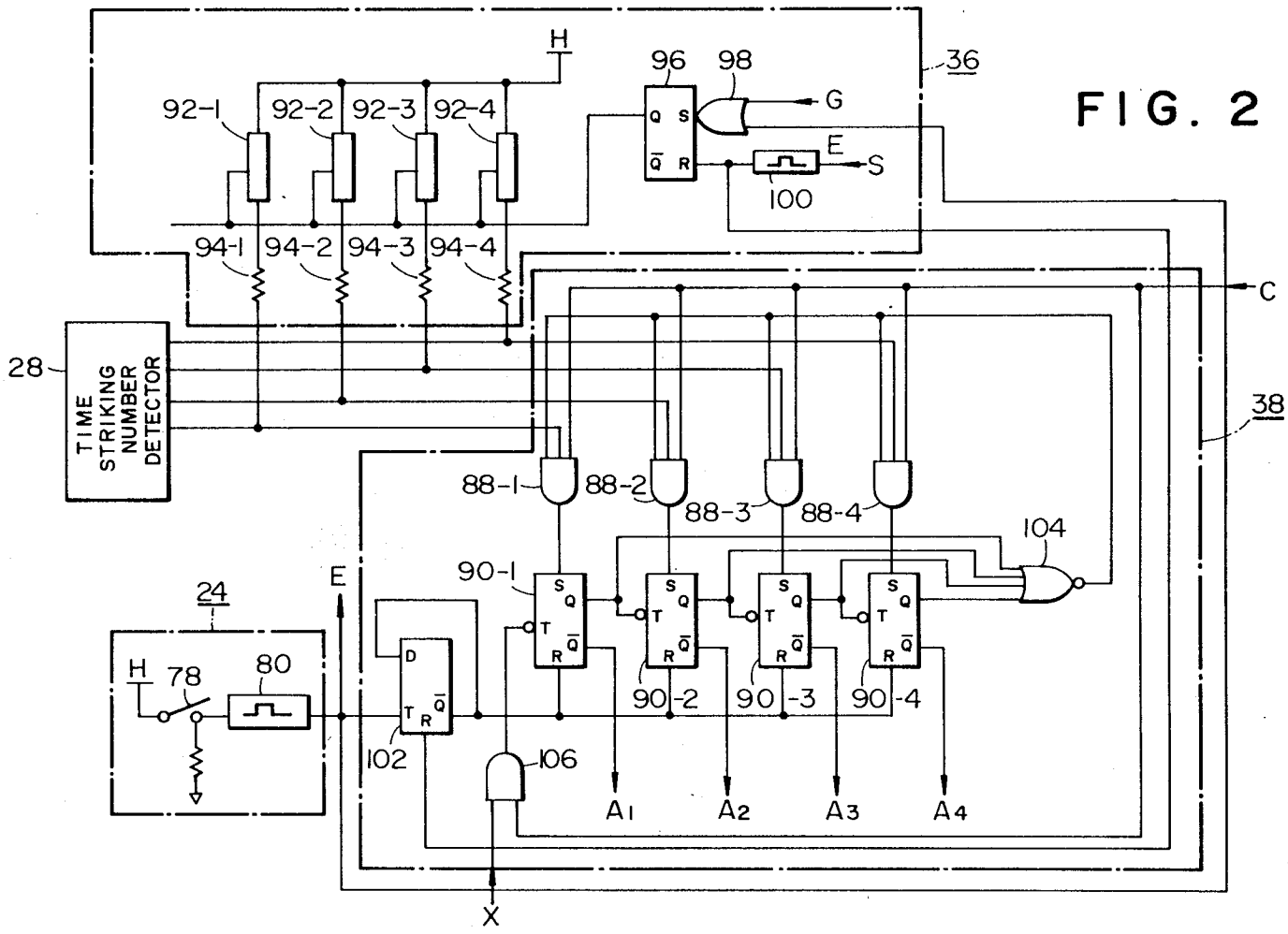
FIG. 2 is a circuit diagram showing a right hour signal detector, a time striking number detector, a power saving circuit and a time striking counter in FIG. 1.

In FIG. 2 the right hour signal detector 24 includes a right hour detecting contact 68 connectedly installed to the minute wheel 20 and a one shot circuit 80, and the right hour signal E supplied with the determined pulse width by the ON action of the contact 78 at the right hour of the indicating time.

The right hour signal E is supplied to the time signalling trigger circuit 26 to reset a counter 82, flip flop (hereinafter referred as FF) 84 and 86. The counter 82 outputs the time signalling trigger signal G every 15 minutes after the right hour as well as the counter 72 outputs time signalling sound directing signals $F_1$ and $F_2$ which are composed of binary numeral and advance each of the FF's 84 and 86 every 15 minutes to change at 15 minutes interval dividing one hour after the right hour into one quarter. In other words, every 15 minutes after the right hour the time signalling sound directing signals $F_1$ and $F_2$ change as written in the following:

| | $F_1$ | $F_2$ |
|---|---|---|
| 0–15 min. | 0 | 0 |
| 15–30 min. | 1 | 0 |
| 30–45 min. | 0 | 1 |
| 45– 0 min. | 1 | 0 |

In FIG. 2, the sliding contact groups of the time striking number detector 28 output the time striking number signal of four bit by way of pull-up resistor group 94, and the time striking number signals become as displayed in the following:

| time | 1 2 3 4 | time | 1 2 3 4 |
|---|---|---|---|
| 1 o'clock | H H H H | 7 o'clock | H L L H |
| 2 o'clock | L H H H | 8 o'clock | L L L H |
| 3 o'clock | H L H H | 9 o'clock | H H H L |
| 4 o'clock | L L H H | 10 o'clock | L H H L |
| 5 o'clock | H H L H | 11 o'clock | H L H L |
| 6 o'clock | L H L H | 12 o'clock | L L H L |

At this time the time striking number signal is applied to the time striking counter 38 to write and determine the time striking numbers at an FF 90-1 through an FF 90-4 by way of AND gates 88-1 through 88-4. The ON action of the AND gate group 78 is controlled by the outputs of the time striking commencement signal C of the time signalling control circuit 40 and the power saving circuit 38, which is described about later. The power saving circuit includes an analog switch group 92, a resister group 94 and an FF 96 which are respectively connected to the time striking number detecting signal lines, and the ON state of the FF 96 makes the writing of the time striking number signal to the time striking counter 38 be effective. In the reset state of the FF 96 the above mentioned writing becomes ineffective to save the electric power consumption. In order to set the FF 96 the above mentioned right hour signal E and time signalling trigger signal G are applied to the set input of the FF 96 by way of an OR gate 98. In the embodiment, the FF 96 is set at 15 minutes interval and the time signalling completion signal S of the time signalling control circuit 40 is applied by way of the one shot circuit 100. The FF 96 is thus reset upon completion of time signalling.

The FF group 90 of the time striking counter 38 is rest by $\overline{Q}$ signal of an FF 102 which is reset by the timesignalling completion signal S. The reset state of the FF 102 is released by the right hour signal E, and the time striking commencement signal C opens the AND gate group 88 so that the time striking number signal from the time striking number detector 28 is written into each of the FF 90. Since the Q outputs of each FF 90 are connected to the inputs of each AND gate 88 by way of a NOR gate 104, the writing action of the FF group 90 is performed only in the reset state of each FF 90. In the time striking action in the adding state of the time striking counter the AND gate group 88 stays in the OFF state at the output of the NOR gate 100, and the time striking number signal of the time striking detector 28 is prevented from applying to the time striking counter 38. The time striking count up signal X is supplied to a trigger input of the FF 90-1 in the first stage. When the AND gate is in the ON state by the time striking commencement signal C, the FF 90-1 is driven by the time striking count up signal X at every one production of time striking sound. Since the FF group 90 forms counters with series connection, its determined values are subtracted at every production of time striking sound. For example, when it is three o'clock, the FF group 90 is written and determined as "H L H H". When two time striking sounds are generated, the Q outputs of the FF group 90 become "H L H H"→"L H H H"→"H H H H". In other words, when the time striking is performed at one smaller number than the requested time striking numbers, all of the Q outputs become L, and the final time striking commencement signal shown as $A_1$ through $A_4$ is output to the time signalling control circuit 40.

Figure 3:
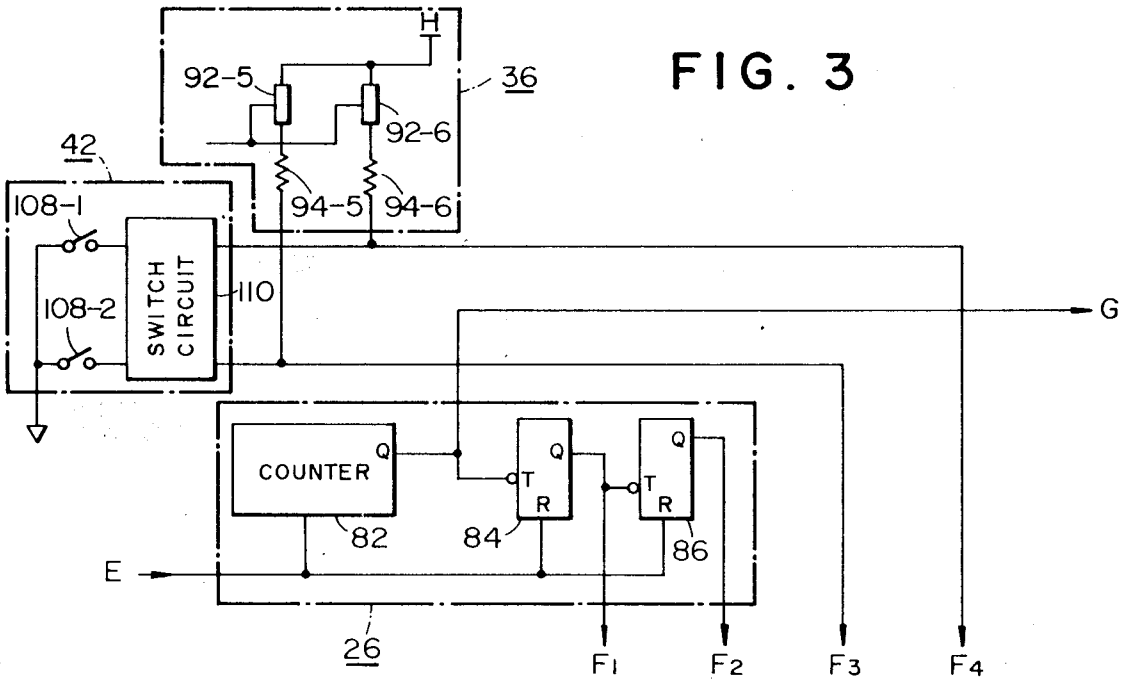
FIG. 3 is a circuit diagram showing a time signalling trigger circuit and a selective switch in FIG. 1.

The select switch 42 in FIG. 3 includes manually operated switches 108-1 and 108-2 and a select circuit 110, and the above mentioned switches 108 change over melody selecting signals $F_3$ and $F_4$. In the embodiment three different kinds of melody sound data memorized in the ROM can be optionally selected.

Figure 4:
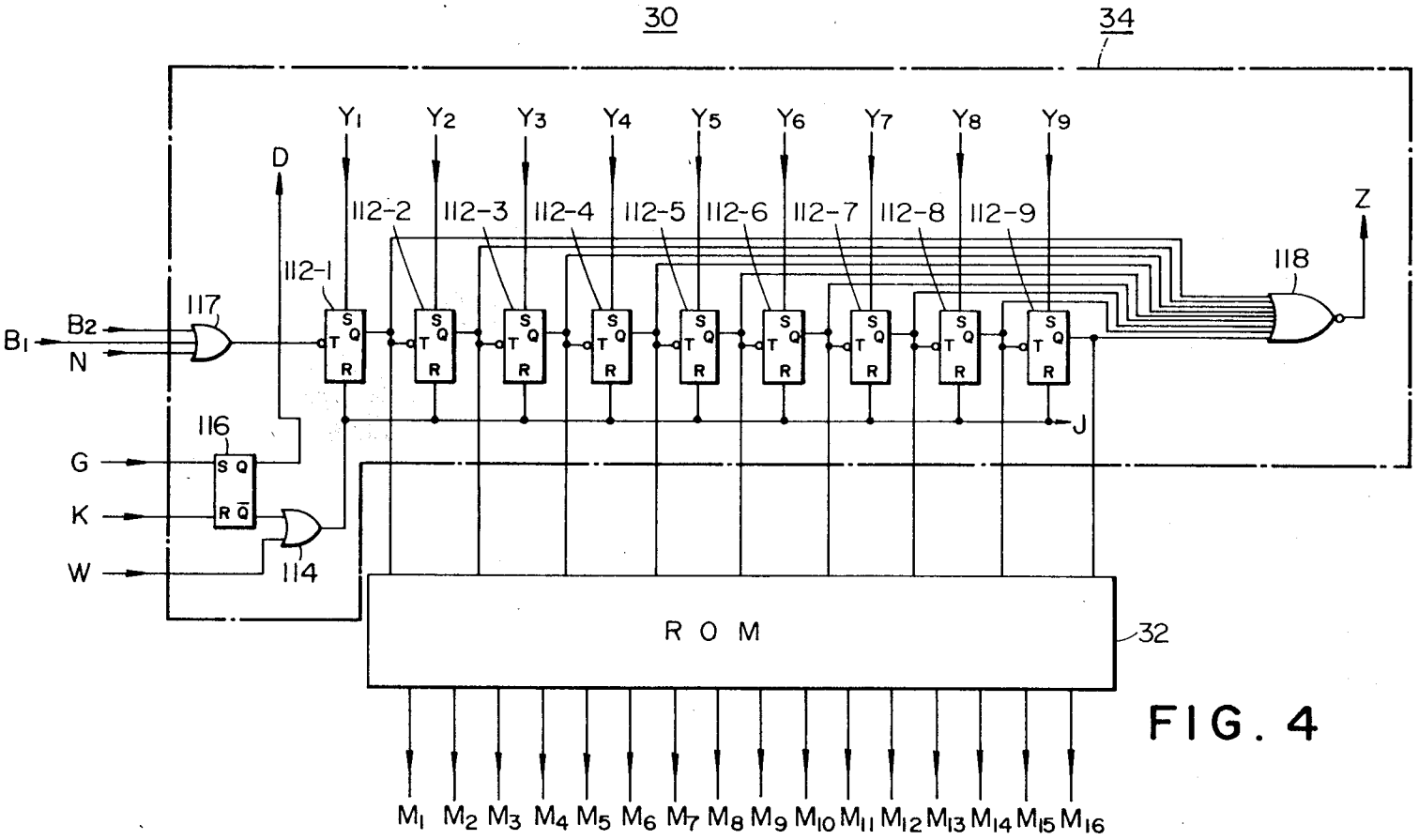
FIG. 4 is a circuit diagram showing a time signalling sound selecting circuit in FIG. 1.

In FIG. 4, shown therein is the time signalling sound selecting circuit 30, and the memorized data of the ROM are read out by the address of the FF group 112 in the address counter 34.

In FIG. 5, shown therein is an example of memorized contents of the ROM 32 and the memorized contents hold three kinds of melody A, melody B and melody C, and the time striking sound data. The respective melody sound data are composed of the melody sound data corresponding to the right hour which accompany the melody sound tempo data, the time striking commencement jump data, the time striking completion jump data, the final time striking sound tempo data and the final time striking sound data, and the melody sound data corresponding to "15 minutes", "30 minutes" and "45 minutes" which accompany the time signalling completion data and the melody sound tempo data, and the time striking sound data accompany the time striking cycle jump data. On the basis of the requested address by the address counter 34 the ROM 32 outputs the ROM program signals $M_1$ through $M_{16}$ of the data corresponding to the addressed.

When this ROM program signal M is the melody sound data or the time striking sound data, signals $M_1$ through $M_3$=data to determine the length of the respective musical notes signal $M_4$=data to control the operation of the envelope circuit 64 signal $M_5$=data to control the operation of the envelope circuit 66 signal $M_6$=data to determine the octave of musical scale output from the programmable divider 48 signal $M_7$=data to determine the octave of musical scale output from the programmable divider 50 signals $M_8$ through $M_{11}$=data to determine the dividing ratio of the programmable divider 48 signals $M_{12}$ through $M_{15}$=data to determine the dividing ratio of the programmable divider 50 signal $M_{16}$=data to discriminate the ROM program signal to be melody sounds or time striking sounds (example: H)

When it is the time striking sound tempo data, the final time striking sound tempo data and the melody sound data, signal $M_6$=data to slow a tempo speed (example: "H" shows double of "L")

signals $M_8$ through $M_{11}$=data to decide the dividing ratio of the tempo counter (using the musical interval ROM of the programmable divider)

signals $M_{13}$ through $M_{16}$=data to discriminate the ROM program signal M to be the tempo data signals $M_1$ through $M_5$, $M_7$ and $M_{12}$=no data When it is the time striking commencement jump data, signals $M_5$ through $M_{11}$=data to indicate the address of the ROM 32 to be jumped signal $M_{13}$ through $M_{16}$=data to discriminate the time striking commencement jump data signals $M_1$ through $M_3$ and $M_{12}$=no data When it is the time striking cycle jump data, signals $M_1$ through $M_3$=data to indicate jumping times signals $M_4$ through $M_{11}$=data to indicate the address of the ROM 32 to be jumped signals $M_{13}$ through $M_{16}$=data to discriminate the time striking cycle jump data signal $M_{12}$=no data When it is the time signalling completion data and the time striking completion data, signals $M_{13}$ through $M_{16}$=data to discriminate the time signalling completion data and the time striking completion data FIG. 6 is an illustration of the memorized contents of the ROM 32 to be shown in memorized order taking the example of memorizing the time signalling of Westminster for the melody.

The right hour melody sound tempo data are input into the first address and the length ($M_1$ through $M_{13}$) of the first musical note of the melody sounds, the octave ($M_6$) and the musical scale data ($M_8$ through $M_{11}$) are input to the next address. In the succeeding address the data ($M_1$ through $M_3$) of the length of the second musical note, and the data of the musical scale ($M_{12}$ through $M_{15}$) of the second musical note and the octave ($M_7$) are input together with the data of the musical scale ($M_8$ through $M_{11}$) of the first musical note and the octave ($M_6$). Also in the third address input are the data of the length ($M_1$ through $M_3$) of the third musical note, the musical scale ($M_8$ through $M_{11}$), the octave ($M_6$), the second musical scale ($M_{12}$ through $M_{15}$) and the octave ($M_7$). The musical note data of the melody sounds at the right hour are input afterwards in the same way as mentioned above. The envelope control data ($M_4$ and $M_5$) become "H" or "L" alternatively at every address. After the right hour melody sounds are input the time striking commencement jump data and the final time striking tempo data come in the next. In the succeeding address are input the musical note data of the final time striking sound. For the time striking sounds the data of two musical scales of the musical note, the octave and the musical note length are input since two musical notes are harmonized. At this time both of the envelope control signals ($M_4$ and $M_5$) become "H". In the next address the musical note data of the same time striking sound with the last sound are input but both of the envelope control signals ($M_4$ and $M_5$) become "L". The time signalling completion data are input into the next address. Succeedingly, the melody tempo data and the musical note data of "15 minutes", "30 minutes" and "45 minutes" are memorized in the same way with the musical note data of the right hour melody.

In the address indicated by the time striking commencement jump data are input the time striking sound tempo data, and the musical note data of the time striking sound are input into the next address. (The envelope control signals $M_4$ and $M_5$ are "H" at this time.) The time striking cycle jump date are input into the next address, and the jump address of this time striking cycle jump data indicate the address of the time striking commencement jump data.

The other two melodies are also memorized in the same way. The ROM program signal M can produce signalling sounds from the sound generator 44 which is hereinafter described about and can output the control signal to the time signalling control circuit 40.

To the FF group 102 of the address counter 34 control program signals $Y_1$ through $Y_8$, which are described about afterwards, from the time signalling control circuit 40 are supplied as setting input, and the control program signal Y can direct the requested content of ROM memories. The FF group 112 is reset by the $\overline{Q}$ output of FF 116 and the time striking reset signal W which is supplied by way of the OR gate 114. The FF 116 is set by the time signalling trigger signal G and reset by the melody reset signal K of the time signalling control circuit 40. The output of the OR gate 114 is shown as reset signal J. To the trigger input of the FF 112-1 in the first stage among the FF group 112 which are connected in series to form counters supplied are the musical note count up signal N and the time striking completion address signal $B_1$ and the tempo set completion signal $B_2$ of the time signalling control circuit 40 by way of OR gate 117 to advance the counter one step whenever the melody tempo or the time striking tempo is set, the melody sound or the time striking sound is produced once and the time striking action is completed, and the address of the ROM 32 is advanced one after another. Furthermore, each of Q outputs from the FF 112 is connected to the input of the NOR gate 118 and supplied to the time signalling control circuit 40 as control program hold signal Z. It is only in the reset state of all the FF 112 that the writing of the control program signal Y is performed, and upon this writing the succeeding writing is held back by the control program hold signal Z.

Figure 7:
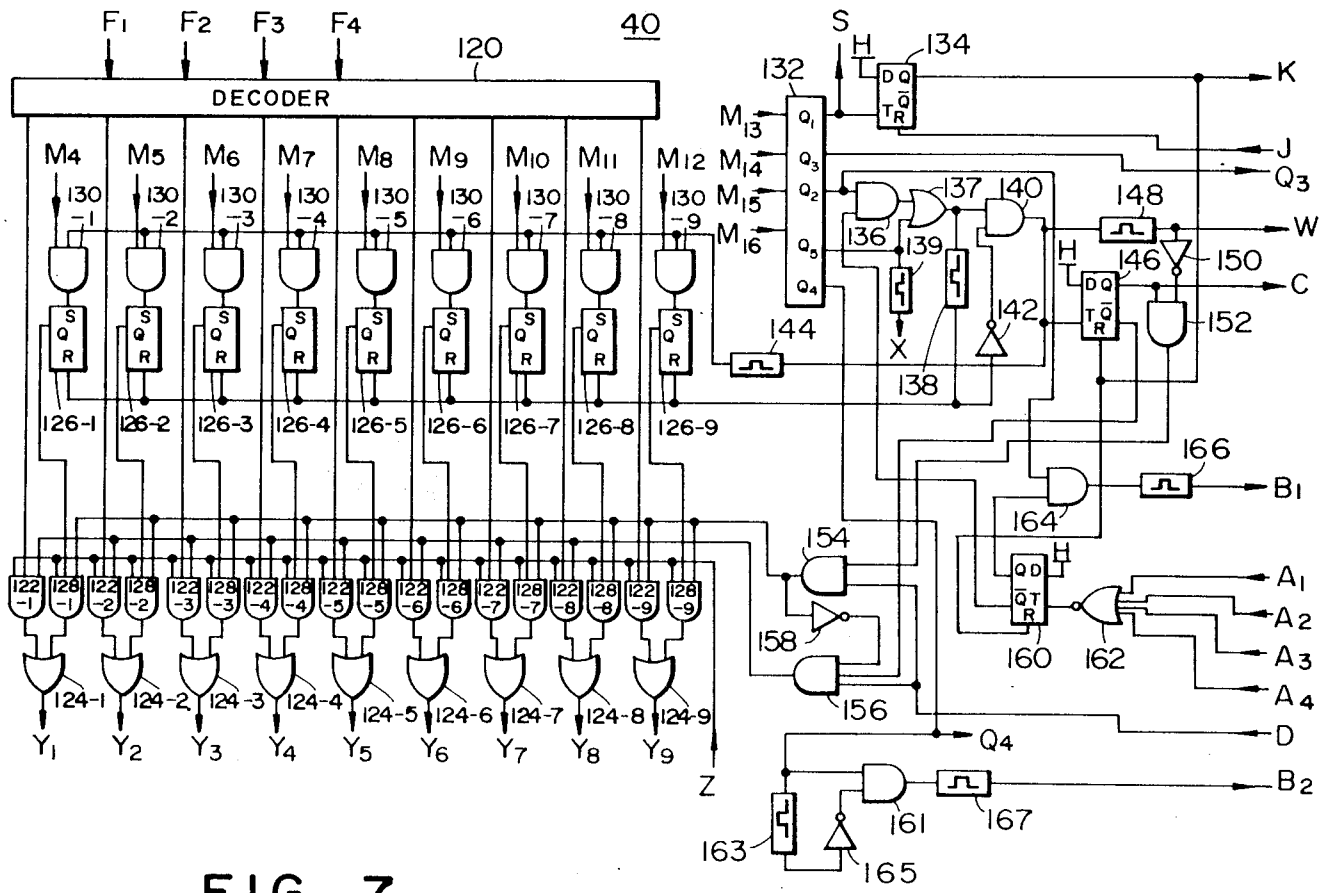
FIG. 7 is a circuit diagram of a time signalling control circuit in FIG. 1.

In FIG. 7, shown therein is a concrete circuit composition of the time signalling control circuit 40. The time signalling sound directing signals $F_1$ and $F_2$ and the melody selecting signals $F_3$ and $F_4$ are converted by the decoder 120, and such converted signals are supplied to the above mentioned address counter 34 as the control program signals $Y_1$ through $Y_8$ which form melody sound data reading signals by way of the melody AND gates 122-1 through 122-9 and the OR gates 124-1 through 124-9. Furthermore, the time signalling control circuit 40 has the time striking FF 126-1 through 126-9, and the determined value of such FF group 126 is supplied to the address counter 34 as the control program signal Y which forms the time striking sound data reading signal by way of the time striking AND gates 128-1 through 128-9 and the OR gate group 114. The values of the time striking FF group 126 are determined by the ROM program signals $M_1$ through $M_9$ of the ROM 32 supplied by way of the AND gates 130-1 through 130-9, and the ROM program signals M become the time striking commencement jump data and the time striking cycle jump data in FIG. 5. In other words, in this embodiment, in order to have the simple circuit composition it is characterized that the combination of the controlling action of the time signalling control circuit 40 and the memorized contents of the ROM 32 control the production of the melody sounds and the time striking sounds, and that the memorized data of the ROM 32 are given feed back to the time signalling control circuit 40 to perform respective control actions.

In order to perform the above mentioned controlling action the time signalling control circuit 40 has a ROM memory decoder 132 and outputs the $Q_1$ and $Q_5$ corresponding to the ROM programing signal M. The output $Q_1$ of the decoder 132 is used for the aforementioned time signalling completion signal S, and triggers the FF 134 to output the melody reset signal K. The FF 134 is in the reset state by the reset signal J together with the afore-mentioned address counter 34. On the other hand, the $Q_2$ output of the decoder 132 outputs H signal when the signals $M_{13}$ through $M_{16}$ are the time striking commencement jump data, and resets the time striking FF group 126 by way of the AND gate 136, the OR gate 137 and the one shot circuit 138. Furthermore, the other output of the AND gate 136 is supplied to the AND gate 140. To the other input of of the AND gate 140 is supplied the output of the one shot circuit 138 by way of the inverter 142 and the output of the AND gate 140 is supplied to the AND gate group 130 by way of the one shot circuit 144 to control the writing of the ROM program signal M into the time striking FF group 126.

The output of the AND gate 140 is further applied to the trigger input of the FF 146 and the Q output of the FF 146 is supplied to the time striking counter 38 as the time striking commencement signal C. The output of the AND gate 140 becomes the time striking reset signal W by way of the one shot circuit 148. This time striking reset signal W is supplied to the one input of the AND gate 152 by way of the inverter 150. To the other input of the AND gate 152 supplied is the Q output of the FF 146 and the output of the AND gate 152 is output to the other input of the AND gate 154. The $\overline{Q}$ output of the FF 146 is supplied to the one input of the AND gate 156 and the other input of the AND gate 156 receives the output of the AND gate 154 by way of the inverter 158. To the AND gates 154 and 156 is supplied the Q output D of the FF 116 in the above mentioned address counter 34 and the output of the AND gate 154 controls the time striking AND gate group 128. The output of the AND gate 156 control the melody AND gate group 122. To the reset input of the above mentioned FF 146 is supplied the melody reset signal K from the FF 134. This melody reset signal K is also supplied to the reset input of the FF 160. To the trigger reset of the FF 160 are also supplied the final time striking commencement signals $A_1$ through $A_4$ by way of the NOR gate 162. The Q output is input to the AND gate 164 together with the $Q_2$ output of the ROM memory decoder 132 and the $\overline{Q}$ output is input to the other input of the AND gate 136. The output of the AND gate 164 is converted into the final time striking count up signal $B_1$ by way of the one shot circuit 166, and supplied to the OR gate 117 in the address counter 34. When all of the FF group 90 in the time striking counter 38 is set in this way, the jump signal from the ROM memory decoder 132 is disregarded so that the final time striking can be commenced.

The $Q_3$ output of the ROM memory decoder 132 opens the AND gate 68 to supply the basic sound signal $P_3$ to the programmable dividers 48 and 50, only when the melody sound data, the time striking data of the final time striking data can be read by the supply of the signals $M_{13}$ through $M_{15}$ from the ROM 32, as well as it opens the AND gates 198, 170-1 through 170-5 in the musical note length counter 70, which will be hereinafter described, to commence counting the musical note length and to enable the musical note length be written in.

The $Q_4$ output of the ROM memory decoder 132 outputs the signal changing from "L" to "H", only when the tempo data can be read out of the ROM 32 by the supply of the signals $M_{13}$ through $M_{15}$ from the ROM 32. This output $Q_4$ is supplied to a latch circuit 190 of the musical note length counter 70, which will be hereinafter described. The output $Q_4$ is also supplied to the one input of the AND gate 161 directly, and the other input receives the $Q_4$ output by way of the one shot circuit 163 and the inverter 165. The output of the AND gate 161 is input to the OR gate 117 of the address counter 30 by way of the one shot circuit 167 as the tempo set completion signal $B_2$. Accordingly, when the tempo data are read out of the ROM 32, the $Q_4$ output sets the tempo data in the musical note length counter 70. The tempo set completion signal $B_1$ is generated afterwards and the address counter 34 is advanced by one step.

The $Q_5$ output of the ROM memory decoder 132 outputs "H", only when the time striking cycle jump data can be read out of the ROM 32. This $Q_5$ output is input to the AND gate 106 by way of the one shot circuit 139 as the time striking count up signal X. The $Q_5$ output is also input into the one shot circuit 138 and the AND gate 140 by way of the OR gate 137 to enable the operation in the same manner as the $Q_4$ output rises up to "H".

The time signalling control circuit 40 is composed of the circuits described heretofore. The ROM memory decoder 132 reads the time signalling completion data of the ROM 32, the time striking commencement jump data and the time striking cycle jump data, and stops the time signalling action by the time signalling completion signal S in completion of time signalling at "15 minutes", "30 minutes" and "45 minutes". On the other hand, at the right hour the $Q_1$ output reads the time striking sound data out of the ROM 32, and the time striking sounds repeat the time striking action until the production of the sounds completes the numbers determined by the time striking counter 38. Then, the ROM memory decoder 132 reads the time striking completion data to complete the time striking action by the output of the time signalling completion signal S.

Figure 8:
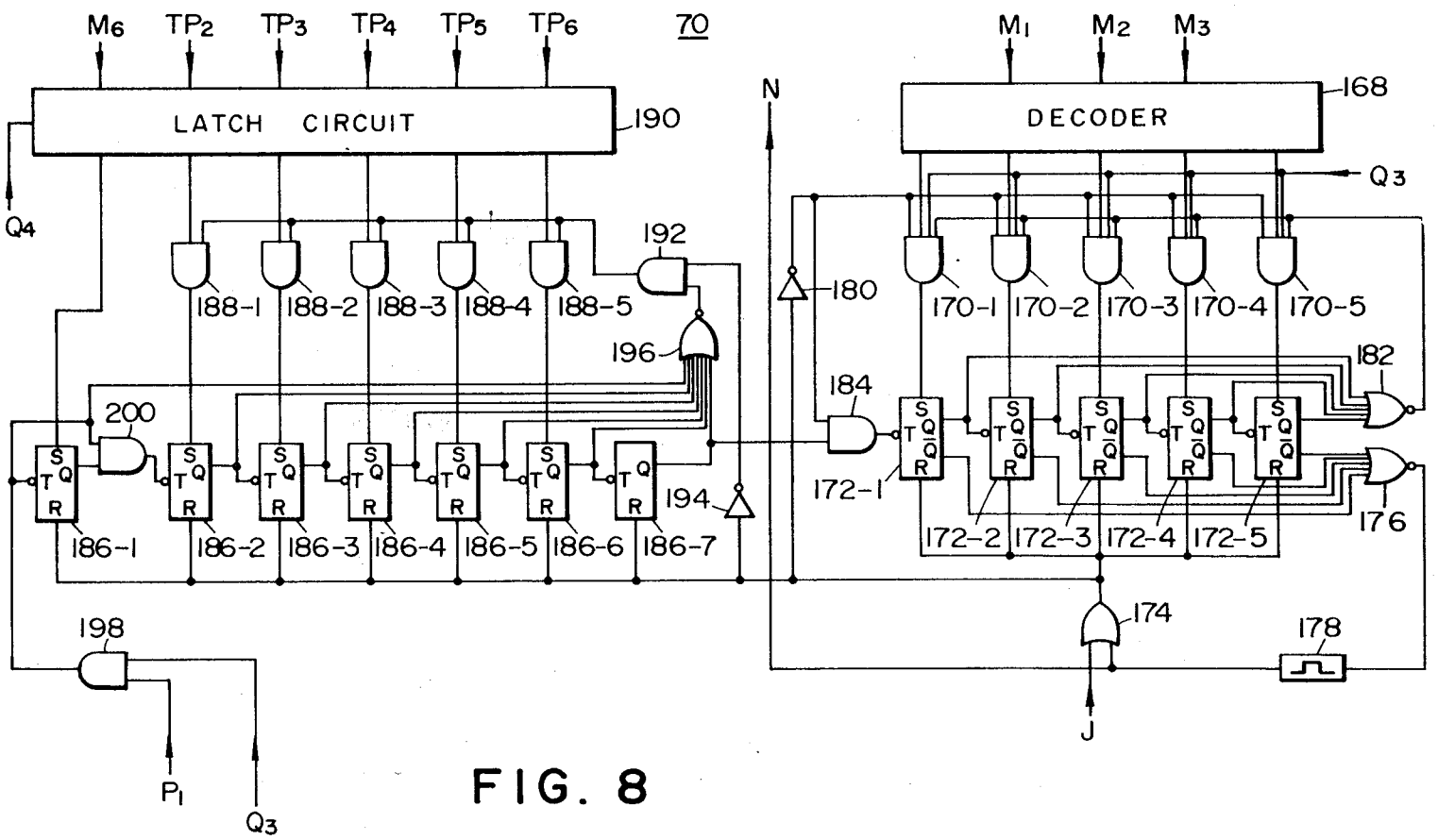
FIG. 8 is a circuit diagram showing a musical note length counter in FIG. 1.

In FIG. 8, shown therein is the musical note length counter 70 of the sound generator 44, and the selected melody sounds or the musical note length corresponding to the time striking sounds are determined there. The musical note length directing signal is formed by the ROM program signals $M_1$ through $M_3$ of the ROM 32. In order to obtain the requested musical note length the musical note length directing signal is converted into the signal of five bit by the decoder 168 and the signal is determined in the FF group 172 which forms the counter by way of the AND gate group 170. Each of the FF 172 is reset by the reset signal J which is supplied by way of the OR gate 174, and is also reset by the supply of the output of the NOR gate 176, which the $\overline{Q}$ outputs of the FF 172 are connected to, to the OR gate 174 by way of the one shot circuit 178. The output of the OR gate 174 is supplied to the AND gate group 170 by way of the inverter 180, and the gate on signal is supplied to the AND gate group 170 only when the reset signal is not provided. The Q outputs of the FF group 172 are supplied to the inputs of the AND gate group 170 together with the $Q_3$ output by way of the NOR gate 182, and it is in the reset state of all the FF 172 that the signal from the decoder 168 is determined at the FF group 172. The writing of the secceeding signals is stopped until the determined value is reset, and the musical note length counter advances during this time. In order to advance the musical note length counter 70, to the trigger input of the FF 172-1 in the first stage supplied is the output of the counter consisting from the FF group 186 by way of the AND gate 184. The set inputs of the FF group 186-2 through 186-6 receive the tempo data $TP_2$ through $TP_6$ of six bit by way of the AND gate group 188 and the latch circuit 190. This tempo data $TP_2$ through $TP_6$ are read out of the musical interval ROM 192 in the programmable divider 48. To the set input of the FF 186-1 input is the tempo high and low signal $M_6$ from the ROM 32 by way of the latch circuit 190. The output of the AND gate 192 is supplied to the AND gate 188, and the signal of the OR gate 174 and the output of the NOR gate 196 are input to the AND gate 192 by way of the inverter 194. To the NOR gate 196 input is the Q output of the FF group 186 and the output of the OR gate 174 is supplied to the reset inputs of the FF group 186. Furthermore, the tempo setting signal $Q_4$ is input to the latch circuit 190 from the ROM memory decoder 132 in the time signalling control circuit 40, and holds the signals of $M_6$, $P_2$ through $P_6$ only when the tempo data can be read out of the ROM 32.

When the FF 186 is reset in this way and the reset signal goes off, the signal $M_6$ and the signals $TP_2$ through $TP_6$ are written into the FF 186-1 through 186-5. To the trigger input of the FF 186-6 in the first stage of the FF group 186 supplied is the basic sound signal $P_1$ from the oscillator 46 by way of the AND gate 198, and the $Q_3$ output of the ROM memory decoder 132 in the time signalling control circuit 40 is supplied to the other input of the AND gate 198. Furthermore, the Q output of the FF 186-1 is input to the AND gate 200 together with the basic sound signal $P_1$ by way of the AND gate 198.

Since the output signal of this AND gate 200 is supplied to the trigger input of FF 186-2 in the next stage, the Q output of the FF 186-1 supplies the signal of the basic sound signal $P_1$ to the FF 186-2 in the next stage with H level, when the signal $M_6$ is H level, and the basic sound signal $P_1$ is divided by $\frac{1}{2}$ by the FF 186-1 and supplied to the FF 186-2, when the signal $M_6$ is L level. The output frequency of the FF 186-7 in the final stage of the FF group 186, therefore, becomes double by the signal $M_6$. Accordingly, the tempo of a music can be made double in spite of the tempo data $TP_2$ through $TP_6$.

The musical note length counter 70 can count the musical note length in accordance with the requested tempo. Furthermore, from the NOR gate 176 of the musical note length counter 70 is supplied the musical note count up signal N which has a fixed pulse width by way of the one shot circuit 178 after the determined musical note length elapses, and the signal N controls the advance of the afore-mentioned address counter 34.

Figure 9:
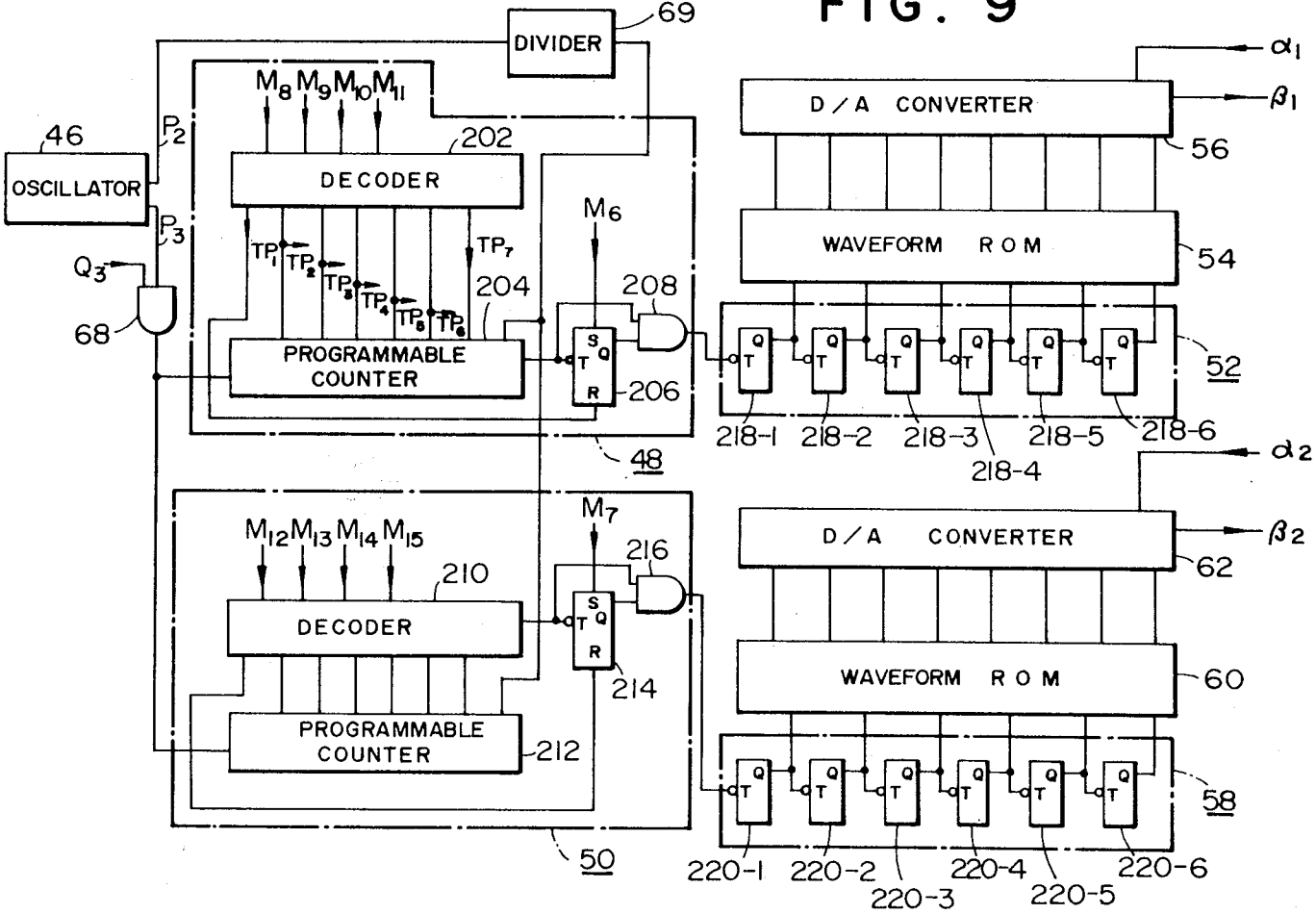
FIG. 9 is a circuit diagram showing the programmable dividers and the address counter in the sound generating circuit.

FIG. 9 shows the detailed circuits of the programmable dividers 48 and 50, and the musical note address counters 52 and 58 in the sound generator 44. The ROM programmable signals $M_8$ through $M_{11}$ are supplied to the decoder 202 of the programmable divider 48 as the musical note selecting signal, and are converted into seven bit signals $TP_1$ through $TP_7$ by the decoder 202. Among these signals the signals $TP_2$ through $TP_7$ are used for the signal which determines the dividing ratio of the variable divider 204, and the signal $TP_1$ is used for the reset signal of the FF 206 which is the trigger input received from the output of the variable divider 204. To the set input S of the FF 206 supplied is the octave setting signal $M_6$ from the ROM 32, and the Q output is input to the AND gate 208 together with the output of the programmable counter 204. Accordingly, the AND gate 208 outputs the dividing output signal from the programmable counter 204, when the signal $M_6$ is H level and the signal $TP_1$ of the decoder 202 is L level. The AND gate 208 outputs the signal which is divided by $\frac{1}{2}$ the dividing output signal from the variable divider 204, that is, the signal of one octave lower musical interval frequency, when the signals $M_6$ and $TP_1$ are L level. The AND gate 208 outputs nothing, when the signal $M_6$ is L and the signal $TP_1$ is H level. As mentioned above, the signals $M_8$ through $M_{11}$ determine the necessary dividing ratio in the programmable counter 204 to output the requested musical scale frequencies, and further, the signal $M_6$ determines the requested octave of the musical scale.

The signals $TP_2$ through $TP_6$ of the decoder 202 become the tempo setting data of the afore-mentioned FF group 186 when the ROM program signal M has the tempo data.

The other programmable divider 50 is also composed in the same way and consists of the decoder 210, the programmable counter 212, the FF 214 and the AND gate 216. To the decoder 210 input are the musical note selecting signals $M_{12}$ through $M_{15}$ from the ROM 32, and to the FF 214 input is the signal $M_7$ from the ROM 32 as the octave setting signal. Both of the programmable counters 204 and 212 divide the basic sound signal $P_3$ received from the oscillator 46 by way of the AND gate 68 to prodece the musical scale frequencies required for the melody sounds and the time striking sounds. On the other hand, to the other input of the AND gate 68 supplied is the $Q_3$ output of the ROM memory decoder 132 in the time signalling control circuit 40 so that the basic sound signal $P_3$ cannot be supplied to the variable dividers 204 and 212 and the sounds cannot be generated when the data read out of the ROM 32 are not the melody sound data or the time striking data.

On the other hand, the basic sound signal P is applied to the divider 69 at the same time, and the low frequency signal for vibratos is supplied to the least significant bit of the programmable counters 208 and 212 from the divider 69. Consequently, the dividing ratio of the programmable dividers 48 and 50 varies in accordance with the change of the low frequency signal for vibratos, and the vibratos effect can be added to the electronic melody sounds or the time striking sounds. Accordingly, the sounds from the speaker 76 are produced with the requested vibration, and the rich and confortable sounds with the naturality as the musical instruments have can be obtained.

The musical interval frequency signal from this programmable divider 48 is input to the address counter 52, and the musical interval frequency signal from the programmable divider 50 is input to the address counter 58. The address counter 52 consists of the FF group 218, and the address counter 58 consists of the FF 220. The FF group 218 counts the musical interval frequency signal from the programmable divider 48 and each of the Q outputs reads the digital waveform memorized in the waveform ROM 54. In the same manner, the FF group 220 counts the musical interval frequency signal from the programmable divider 50, and reads the contents memorized in the waveform ROM 60. In the waveform ROM's 54 and 60 the one period amplitude of the stick bell sounds is divided into 64 and memorized after the conversion into eight bit digital words. Out of the ROM's 54 and 64 the 64 words are read one after another in accordance with the count output of the FF group 218 and 220. The D/A counters 56 and 62 convert these into the analog voltage value.

Figure 10:
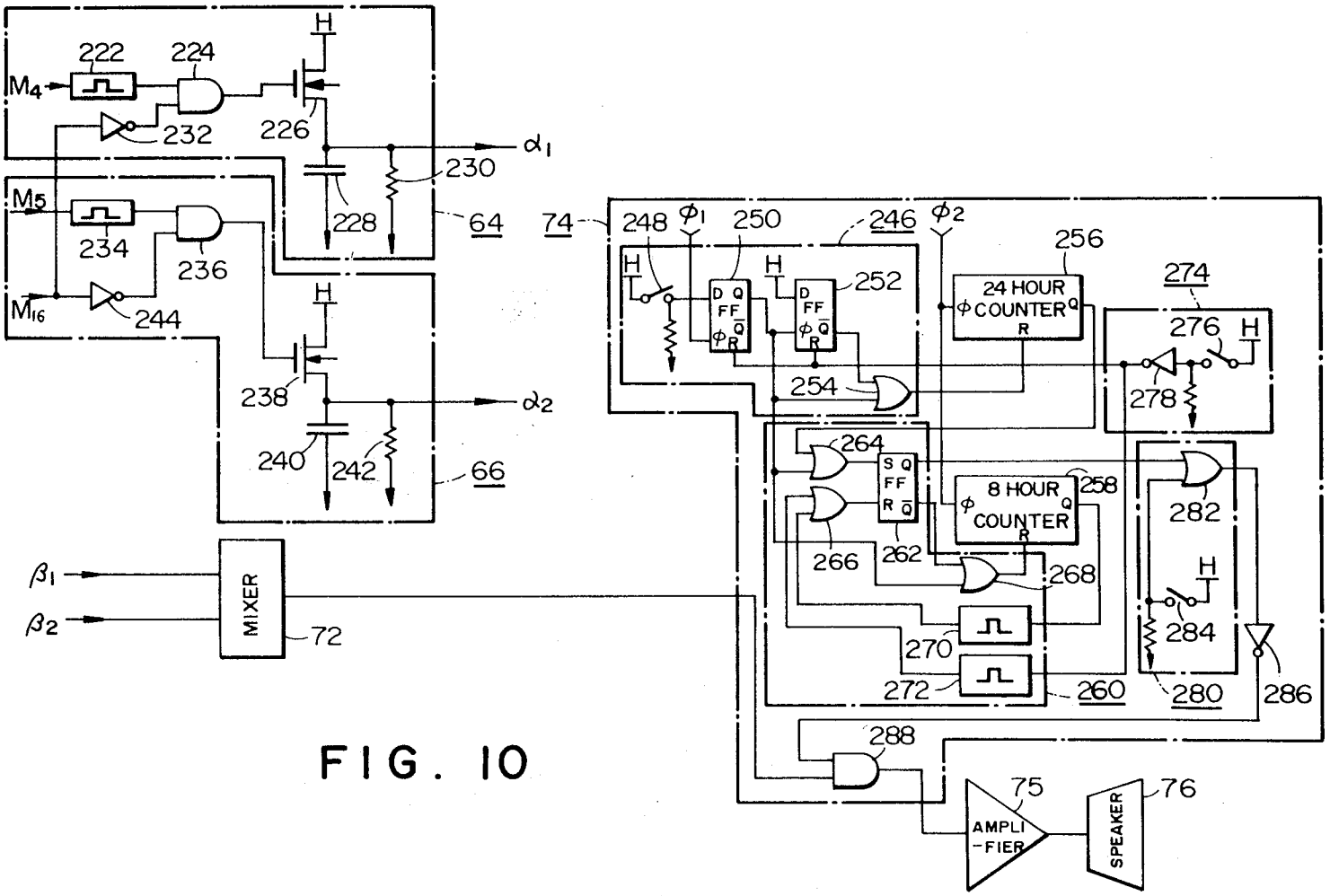
FIG. 10 is a circuit diagram showing the envelope circuits and the pausing circuit in the sound generating circuit.

The D/A converters 56 and 62 have the envelope circuits 64 and 66 as shown in FIG. 10. The envelope circuit 64 includes the discharge circuit composed of FET 226 which the envelope signal $M_4$ is input to by way of the one shot circuit 222 and the AND gate circuit 224, the capacitor 228 and the resister 230. To the other input of the AND gate 224 supplied is the signal $M_{16}$ from the ROM 32 by way of the inverter 232 to open the AND gate 224 only when the time striking sounds and the melody sounds are generated. The envelope circuit 66 is also composed of the one shot circuit 234 which the signal $M_5$ is input to, the AND gate 236, the FET 238, the capacitor 240, the resister 242 and the inverter 244 in the same way as the the envelope circuit 64. These envelope circuits output the envelope signals which attenuate at the determined time constant at the same time of the musical note generation and the envelope action can be obtained by superimposing the envelope signal and the outputs of the waveform ROM's 52 and 58 at the D/A converters 56 and 62.

The sounds from the speaker 66 are, therefore, output as the sounds close to the natural sounds which are attenuated as the time elapses to perform comfortable sound producing action with good quality.

The outputs of the D/A converters 56 and 62 are mixed by the mixer 72, and supplied to the speaker 76 by way of the amplifier 75. The sound generator 44 in the embodiment further includes the time signalling pausing circuit 74 and the time signalling action can be halted during the predetermined period when the time signalling sounds are not required, sleeping time for example.

The time signalling pausing circuit 72 includes the time signalling pausing switch circuit 246, which is composed of a switch 248,FF 250 and 252, and an OR gate 182. The FF 250 is driven by the switch 248, and the Q output of the FF 200 and the $\overline{Q}$ output of the FF 252 are connected to the OR gate 254. The output of the OR gate 254 is applied to the reset input of the 24 hour counter 256 which detects the time signalling pause starting time.

The time signalling pausing circuit 72 in this embodiment includes the eight hour counter 258 which counts the time signalling pausing hours as well as the time signalling pausing circuit 72 has the above mentioned 24 hour counter 256. A pausing control circuit 260 includes the FF 262. The Q output of the 24 hour counter 256 and the Q output of the FF 250 are applied to the set input of the FF 262 by way of the OR gate 264, and the output of the OR gate 266 is applied to the reset input. The $\overline{Q}$ output of the FF 262 and the Q output of the FF 250 in the above mentioned time signalling pausing switch circuit 246 are applied to the reset input of the eight hour counter 258 by way of the OR gate 268. The pausing control circuit 260 includes the one shot circuits 270 and 272. The Q output of the eight hour counter 258 is applied to the OR gate 266 by way of the one shot circuit 270, and the output of the pause release switch circuit 274, which will be hereinafter described, is applied to the OR gate 266 by way of the one shot circuit 272. The pause release switch circuit 274 includes a switch 276 and an inverter 278, which reset both of the FF 250 and FF 252 in the time signalling pausing switch circuit 246.

The Q output of the FF 262 in the pausing control circuit 260 is applied to the OR gate 282 of the time signalling forbidding switch circuit 208, and to the other input of the OR gate 282 supplied is the output of the switch 284. The output of the OR gate 282 is applied to the one input of the AND gate 288 by way of the inverter 286, and to the other input of the AND gate 288 applied is the output of the mixer 72 of the sound generator 44. Furthermore, the output of the AND gate 288 is applied to the amplifier 75.

The time signalling pausing circuit 74 in this embodiment is composed as described heretofore, and the operation of this circuit will be hereinafter described.

In closing the switch 284 of the time signalling forbidding switch circuit 280 the signal "L" is always applied to the AND gate 288 by way of the inverter 286. Consequently, the closure of the switch 284 obstracts supplying the output of the mixer 72 to the amplifier 75 and the time signalling action is halted during this time.

In the ordinary using conditions, the above mentioned switch 284 is open. When the switch 276 of the pause release switch circuit 274 is closed in such state, the output become "L" signal to release the reset state of the FF 250 and 252 in the time signalling pausing switch 246. When the switch 248 of the time signalling pausing switch circuit 246 is temporarily switched on, the "H" signal is supplied to the FF 250. In such state the apply of the clock pulse $\emptyset_1$ makes the output of the FF 250 into "H", and, when the above mentioned switch 248 is opened afterwards, the Q output of the FF 250 returns back to "L" by the rise of the clock pulse. Consequently, the trigger pulse is generated at the Q output of the FF 250. The rise of the trigger pulse changes the $\overline{Q}$ output of the FF 252 from "H" to "L" to release the reset state of the 24 hour counter 256, and the counter 256 starts counting the clock pulse $\emptyset_2$.

On the other hand, the $\overline{Q}$ output of the FF 250 sets the FF 262 of the pausing control circuit 260, and the time signalling pausing action starts since the Q output of the FF 262 activates the time signalling forbidding switch circuit 280 to make the AND gate be in the gate OFF state by way of the inverter 286 in the same manner as described in the above. At the same time, the Q output of the FF 250 releases the reset state of the eight hour counter 258, and the counter 258 starts counting the clock pulse $\emptyset_2$.

After eight hours elapse from the start of the pause mentioned in the above the Q output is generated from the eight hour counter 258, and the FF 262 of the pausing control circuit 260 is put in the reset state by way of the one shot circuit 270 and the OR gate 266 to make the output of the time signalling forbidding switch circuit 280 into "L", and further, the AND gate 288 is put in the gate ON state to restart the time signalling action. At the same time, the eight hour counter 258 is also put in the reset state by the FF 262.

After 24 hours elapse from the temporary ON operation of the switch 248 of the time signalling pausing switch circuit 246, the Q output is generated from the 24 hour counter 256 to reset the FF 262 of the pausing control circuit 260 by way of the OR gate 264. Accordingly, the AND gate 288 is again put in the gate OFF state and the time signalling pausing action is started.

As mentioned heretofore, every 24 hours the time signalling action is halted for eight hours, and the selection of the requested pause starting time can perform the optional time signalling pause during the unnecessary time of the time signalling. The above mentioned pause starting time is determined by the time of temporary ON-operation of the switch 248, and the determining time can be optionally corrected and changed.

As described heretofore, according to the illustrated embodiment, the optional time period can be selected as the time signalling pausing time, and the optional change of the count value in the eight hour counter 258 in the embodiment can freely determine the time signalling pausing period.

The embodiment of the present invention is composed as described heretofore, and the melody sound and the time striking sound generating operation in accordance with the present invention will be hereinbelow described with reference to FIGS. 11 and 12.

In the illustrated embodiment the requested melody sounds and the time striking sounds in accordance with the numbers corresponding to the indicated time are produced at the right hours, and at 15 minute interval from the right hour, that is, "15 minutes", "30 minutes" and "45 minutes" produced are the requested melody sounds respectively. Each of the melody sounds produced at 15 minute interval is formed out of different kind rows of musical notes.

Figure 11:
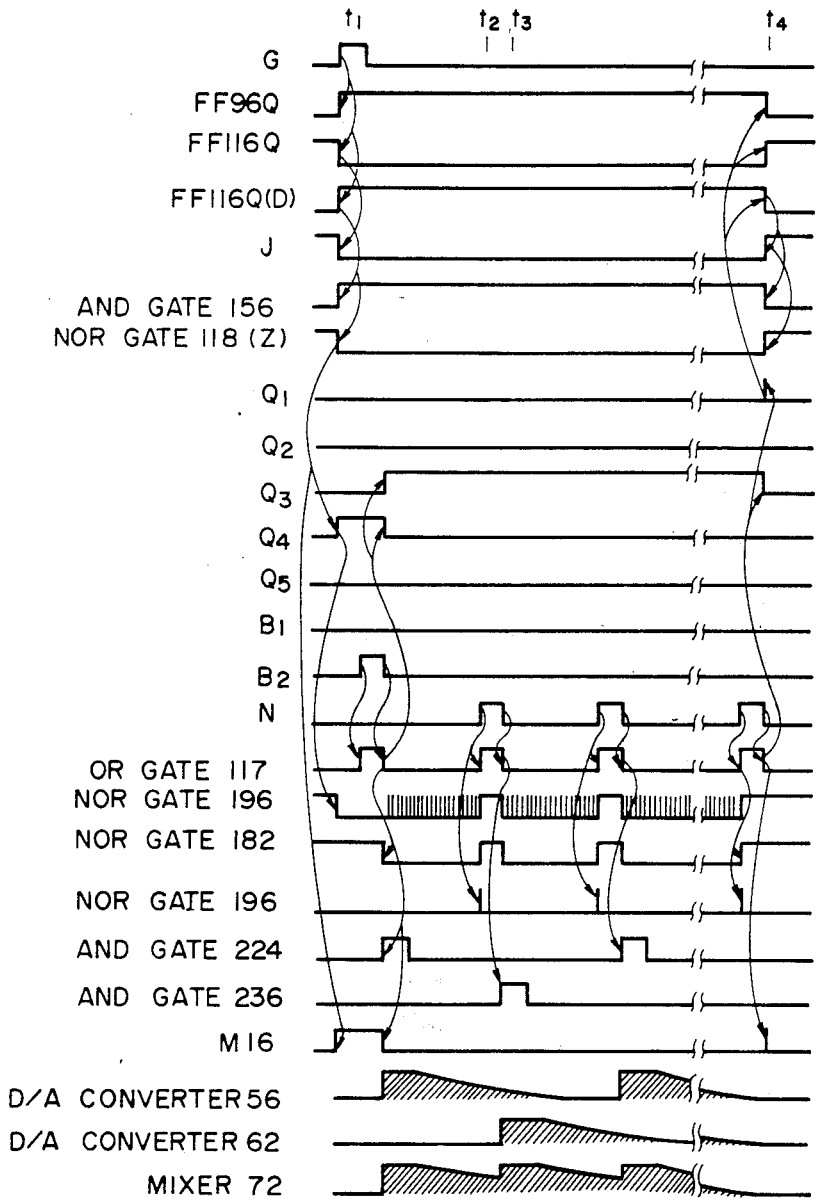
FIG. 11 is a timing chart showing the time signalling action at a quarter hour in the embodiment of FIG. 1.

In FIG. 11, shown therein is a melody sound generating action at each quarter hour of "15 minutes", "30 minutes" and "45 minutes" which do not accompany the time striking action, and each of the above mentioned Figures shows such state that the indicating time is ten minutes after two. All of the FF's are in the reset state to wait for the next melody sound production at the time of "15 minutes".

When the time indicates 2:15 ($t_1$), the time signalling trigger signal G is output from the counter 82 of the time signalling trigger circuit 26 to set the FF 96 of the power saving circuit 36, and makes the operation of the time signalling device effective. Accordingly, the melody selecting signals $F_3$ and $F_4$ selected by the select switch 42 can be supplied to the decoder 110 of the time signalling control circuit 40. The time signalling trigger signal G sets the FF 116 of the address counter 34 to release the reset state of the FF group 112 by the change of the reset signal J into "L". The Q output D of the FF 116 turns to "H", and the gate ON signal is supplied from the AND gate 156 of the time signalling control circuit 40 to the melody sound AND gate group 122. Thus, the time signalling control circuit 40 supplies the output of decoder 120 out of the AND gate group 122 and the OR gate group 124 to the address counter 34. It is, therefore, understood that the control program signal Y is used as the melody sound data reading signal. Since the above mentioned melody selecting signals $F_3$ and $F_4$ and the time signalling sound directing signals $F_1$ and $F_2$ of the time signalling circuit 26 are supplied to the decoder 120, the melody sounds preselected by a user and the melody sound data reading signal determined by the time signalling sound corresponding to "15 minute" is established in the FF group 112 of the address counter 34. Since the establishment of the FF group 112 supplies the Q output of "H" from either one of the FF 112 at least to the NOR gate 118, the control program holding signal Z which is the output of the NOR gate 118 becomes "L", and the above mentioned melody AND gate group 112 turns into the gate OFF state to obstruct the supply of the output of the decoder 120 to the FF group 112 until the read of the directed melody sound data is completed.

The ROM 32 directs the melody sound data reading signal established in the group of the FF 112 as the address, and reads the melody sound tempo data of "15 minutes" corresponding to the requested melody $A_2$, for example, out of the ROM 32. Among these tempo data $M_1$ through $M_{16}$ the data $M_{13}$ through $M_{15}$ turn the $Q_4$ output of the ROM memory decoder 132 from "L" to "H". The latch circuit 190 of the musical note length counter 70 latches the tempo data $TP_2$ through $TP_6$ from the decoder 202 of the programmabme divider 48 and the tempo high and low data $M_6$, and the tempo data $TP_2$ through $TP_6$ and the tempo high and low data $M_6$ are established in the FF group 186. The signal of the NOR gate 196 becomes "L" when the FF group 186 is established, and the AND gate 192 and the AND gate group 188 are closed to obstruct the input of the data from the latch circuit 190 to the FF group 186.

Afterwards, the tempo set completion signal $B_2$ is input from the one shot circuit 167 in the time signalling control circuit 40 to the FF group 112 by way of the OR gate 117 of the address counter 30 to advance the count of the address counter 30 by one step. Accordingly, among the ROM program signal M, the signals $M_1$ through $M_3$ obtain the first musical note length data of the melody sounds for "15 minutes", the signals $M_4$ and $M_5$ obtain the envelope signals ($M_4$="H" and $M_5$="L"), the signals $M_6$ and $M_7$ obtain the octave data, the signals $M_8$ through $M_{11}$ obtain the first musical note data of the melody sounds for "15 minutes", the signals $M_{12}$ through $M_{15}$ obtain the data of rest, and the signal $M_{16}$ obtains the data ("H") showing the musical note data. The signal $M_{16}$ further turns the $Q_3$ output of the ROM memory decoder 132 to "H" and the $Q_4$ to "L", and puts the AND gate 68, the AND gate 198 of the musical note length counter 70 and the AND gate group 170 in the gate ON state. The signals $M_8$ through $M_{11}$ are input to the programmable counter 204 by way of the decoder 202 of the programmable divider 48 to determine the dividing ratio of the programmable counter 204. This programmable counter 204 divides the basic sound signal $P_3$ input by way of the AND gate 68 into the requested frequency. The signal $M_6$ is input to the FF 206 of the programmable divider 48, and the frequency signal divided by the programmable counter 204 is supplied to the FF group 218 of the address counter 52 by way of the AND gate 208 as it is when the signal $M_6$ is "H". When the signal $M_6$ is "L", the frequency signal divided by the programmable counter 204 is further divided by ½ and input to the FF group 218. Accordingly, when the signal $M_6$ is "L", the musical scale frequency is obtained one octave lower than when it is "H".

At this time, if the musical note data output from the ROM 32 are as follows, for example, the frequency fo output from the programmable divider 48 is as follows: ($P_3$=1.048576 MHz)

| | |
|---|---|
| musical scale $G_2$ | fo = 6272 Hz(=98 Hz × 64) about 98 Hz |
| musical scale $C_3$ | fo = 8384 Hz(=131 Hz × 64) about 131 Hz |
| musical scale $D_3$ | fo = 9408 Hz(=147 Hz × 64) about 147 Hz |
| musical scale $E_3$ | fo = 10560 Hz(=165 Hz × 64) about 165 Hz |

The output frequency fo from this programmable dividers 48 and 50 is divided into 64 by the six bit FF groups 218 and 220, and their count outputs give access to the waveform ROM's 54 and 60. Accordingly, the digital signal waveforms memorized in the waveform ROM's 54 and 60 can be read one after another at the eight bit output. At this time, the output frequency fo from the programmable divider 48 is 8384 Hz, the waveform 54 is given access by 131 times (8384÷64=131) and the basic musical scale ($C_3$) frequency of 131 Hz is output from the ROM 54. In the same manner, output is the waveform memorized at the frequency of (the frequency fo' from the programmable divider 50)÷(64 Hz). The digital waveforms from the waveform ROM's 54 and 60 are respectively input to the D/A converters 56 and 62. The D/A converters 56 and 62 convert the waveforms memorized in the waveform ROM's 54 and 60 into the analog waveforms and for one second output the waveforms by numbers which are equal to the musical scale frequency. In other words, if the musical scale frequency is 131 Hz, 131 waveforms are repeatedly output.

In this state, since the signals $M_4$ ("H"), $M_5$ ("L") and $M_{16}$ ("H") are input to the envelope circuits 64 and 66 which are respectively connected to the D/A converters 56 and 62, the D/A converter does not work, but the D/A converter 56 only outputs the attenuating signal. Consequently, the D/A converter 56 outputs nothing, and the waveforms repeatedly output from the waveform ROM 54 is output with attenuation from the D/A counter 56. This signal is input to the speaker 76 by way of the mixer 72 and the amplifier 75, and the stick bell sounds are produced from the speaker 76 with requested musical scale.

At the same time when the musical scale data $M_8$ through $M_{15}$ of the musical notes, the data $M_1$ through $M_3$ showing the length of the musical notes are input to the FF group 172 by way of the decoder 168 and the AND gate group 170 of the musical note length counter 70. When these data $M_1$ through $M_3$ of the musical note length are input to the FF group 172, the output of the NOR gate 182 turns from "H" to "L", and close the AND gate group 170 to obstruct the signals from the decoder 168 from inputting into the FF group 172 afterwards.

At the same time, the change of the output $Q_3$ supplied from the ROM memory decoder 132 from "L" to "H" starts counting the basic sound signal $P_1$, and the FF group 186 counts the tempo by means of dividing at the determined dividing ratio. The FF group 172 counts the tempo frequency at the dividing ratio established by the musical note length data $M_1$ through $M_3$.

At the time of $t_2$ the FF group 172 of the musical note length counter 70 completes counting the predetermined musical note length, and the output of the NOR gate 176 turns into "H" so that the musical note count up signal N having the constant pulse width by means of one shot circuit 160 is output. This musical note count up signal N resets the FF groups 172 and 186 to wait for the input of the next musical note length signal of the FF group 172. At the same time, the musical note count up signal N advances the address counter 34 by one step to read the second musical note data in the melody sound data of the ROM 32. At this time, as previously described, the time signalling control circuit 40 is held back by the control program hold signal Z of the address counter 34, and the contents of the decoder 120 do not effect the address counter 34 at all. Among the second melody sound data $M_1$ through $M_{16}$ the signals $M_1$ through $M_3$ obtain the data of the second musical note length of the "15 minutes" melody, the signals $M_4$ and $M_5$ obtain the data ($M_4$="L" and $M_5$="H" in this case) which control the envelope circuits 64 and 66, the signal $M_6$ obtains the musical scale octave data of the first musical note of the melody, the signal $M_7$ obtains the musical scale octave data of the second musical note of the melody, the signals $M_8$ through $M_{11}$ obtain the musical scale data of the first musical note, the signals $M_{12}$ through $M_{15}$ obtain the musical scale data of the second musical note, and the signal $M_{16}$ obtains the data ("L") which discriminate the musical note data.

The signals $M_1$ through $M_3$ are immediately written in the decoder 168 of the musical note length counter 70, and this converted information is written into the FF group 172 at the moment when the output of the one shot circuit 178 gets down and puts the AND gate group 170 in the gate ON state, and the output signal of the NOR gate 182 gets down at the same time ($t_3$). At the same time of the write of the first musical note length, the down establishment of the NOR gate 182 by the FF group 172 again holds the AND gate group 170 and the musical note length by the basic sound signal $P_1$ is counted.

The musical scale frequency of the first musical note is succeedingly output from the programmable divider 48 by the signals $M_5$ and $M_8$ through $M_{11}$, and the musical scale frequency of the second musical note is output from the programmable divider 50 by the signals $M_6$ and $M_{12}$ through $M_{15}$. Accordingly, the digital waveforms are respectively output from the waveform ROM's 54 and 60, but the D/A converter 56 outputs nothing and the D/A converter 62 produces repeating waveform sounds with attenuation, since the signal $M_4$ is "L", the signal $M_5$ is "H" and the signal $M_{16}$ is "L" at this time. Consequently, the signal of the second musical note is input to the speaker 76 by way of the mixer 72 and the amplifier 75 to generate the stick bell sound of the second musical scale.

As described heretofore, the melody sound musical note data are read out of the ROM 32 one after another to alternatively generate the respective musical note signals of the melody sounds from the D/A converters 56 and 62. When all of the melody sound data are read out, the time signalling completion data at the time of $t_4$. The signals $M_{13}$ through $M_{16}$ in the time signalling completion data turn the output $Q_3$ of the ROM memory decoder into "L" and the output $Q_1$ into "H". This output $Q_3$ puts the AND gate 68, the AND gate 198 in the musical note length counter 70 and the AND gate group 178 in the gate OFF state, and the basic music signal from the oscillator is not supplied to the musical note length counter 70 and the programmable dividers 48 and 50. The $Q_1$ output supplies the "H" time signalling completion signal S. This time signalling completion signal S sets the FF 134 to turn the melody reset signal K into "H", and the FF 116 of the address counter 34 is put in the reset state. Accordingly, the FF group 112 of the address counter 34 is totally put in the reset state, and the Q output D of the FF 116 becomes "L" as well as the output of the AND gate 156 in the time signalling control circuit 40 turns into "L" to put the AND gate group 122 in the gate OFF state. Furthermore, the reset signal J of the address counter 34 also resets the musical note length counter 70. At the time of $t_4$ since the "H" signal is momentarily supplied from the NOR gate 176 and operates the one shot circuit 178, the one shot pulse is input to the address counter 34, but this can be disregarded since the FF group 112 is put in the reset state. Incidentally, by the reset state of the address counter 34 at the time of $t_4$ the ROM program signal M from the ROM 32 shows the reset data and the ROM memory decoder 132 of the time signalling control circuit 40 immediately inverts its output $Q_2$ into "L".

The time signalling completion signal S resets the power saving circuit 36 and prevent the unnecessary power consumption until next time signalling.

As mentioned in the above, at the time of "15 minutes" the ROM memory decoder 132 of the time signalling contro circuit 40 reads the time signalling completion data of the ROM 32 to stop all of the time signalling action, and the time signalling control action can be easily obtained by the cooperating operation between the time signalling control circuit 40 and the ROM 32 without using any complicated circuit composition. The operations at "30 minutes" and "45 minutes" when the time striking sounds are not required are performed in the same way. In these time signalling states the time signalling sound directing signals $F_1$ and $F_2$ from the time signalling trigger circuit 26 simply change and the corresponding different melody sound data are read out of the ROM 32. In the same manner, in the selection of the melody sounds, the melody sound data of the ROM 32 are selected in accordance with the melody selecting signals $F_3$ and $F_4$ supplied from the switch 42, and the operation of each circuit is same at all as the time of "15 minutes" described in the above.

Figures 1, 12:
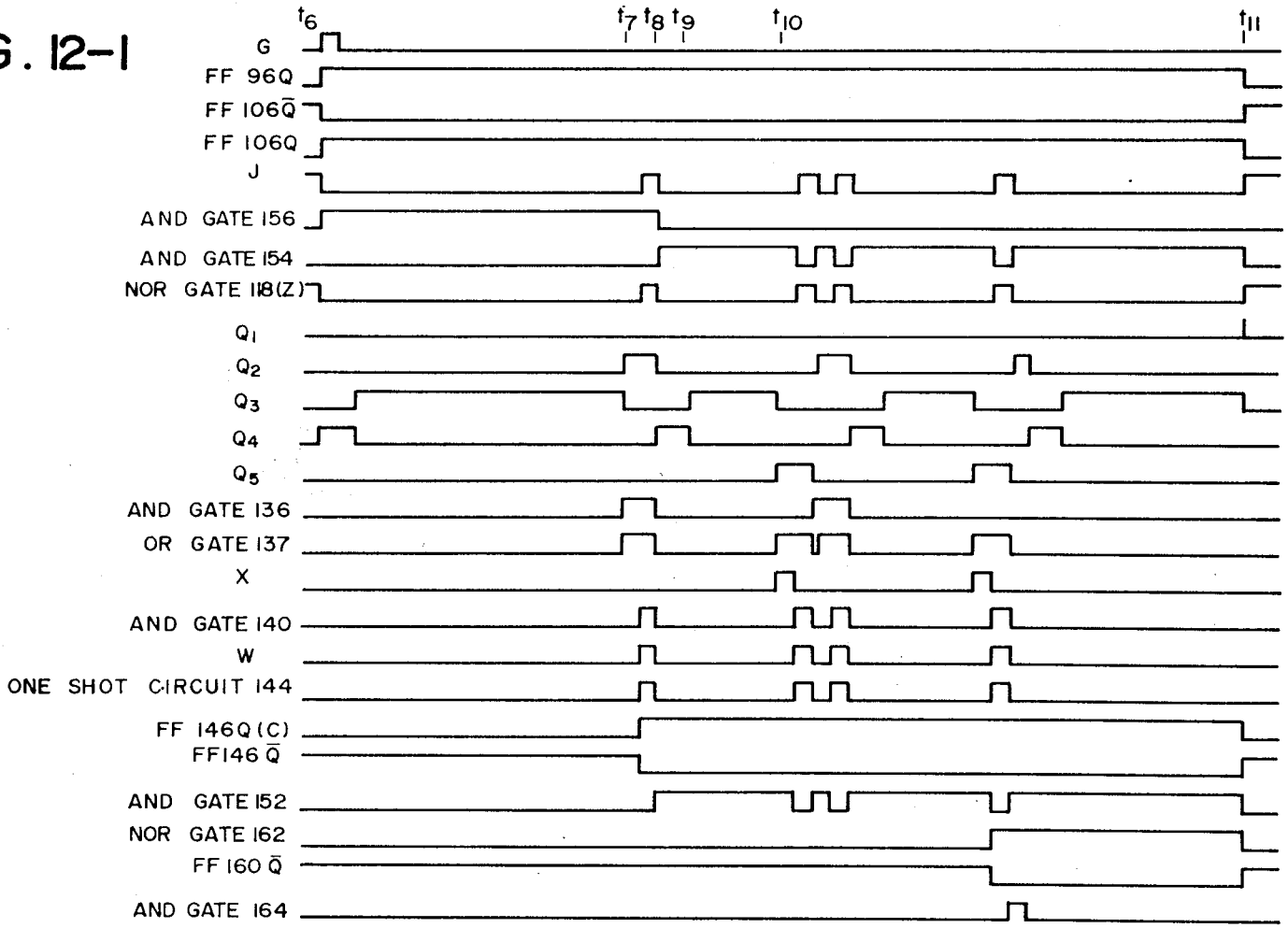
Figures 2, 12:
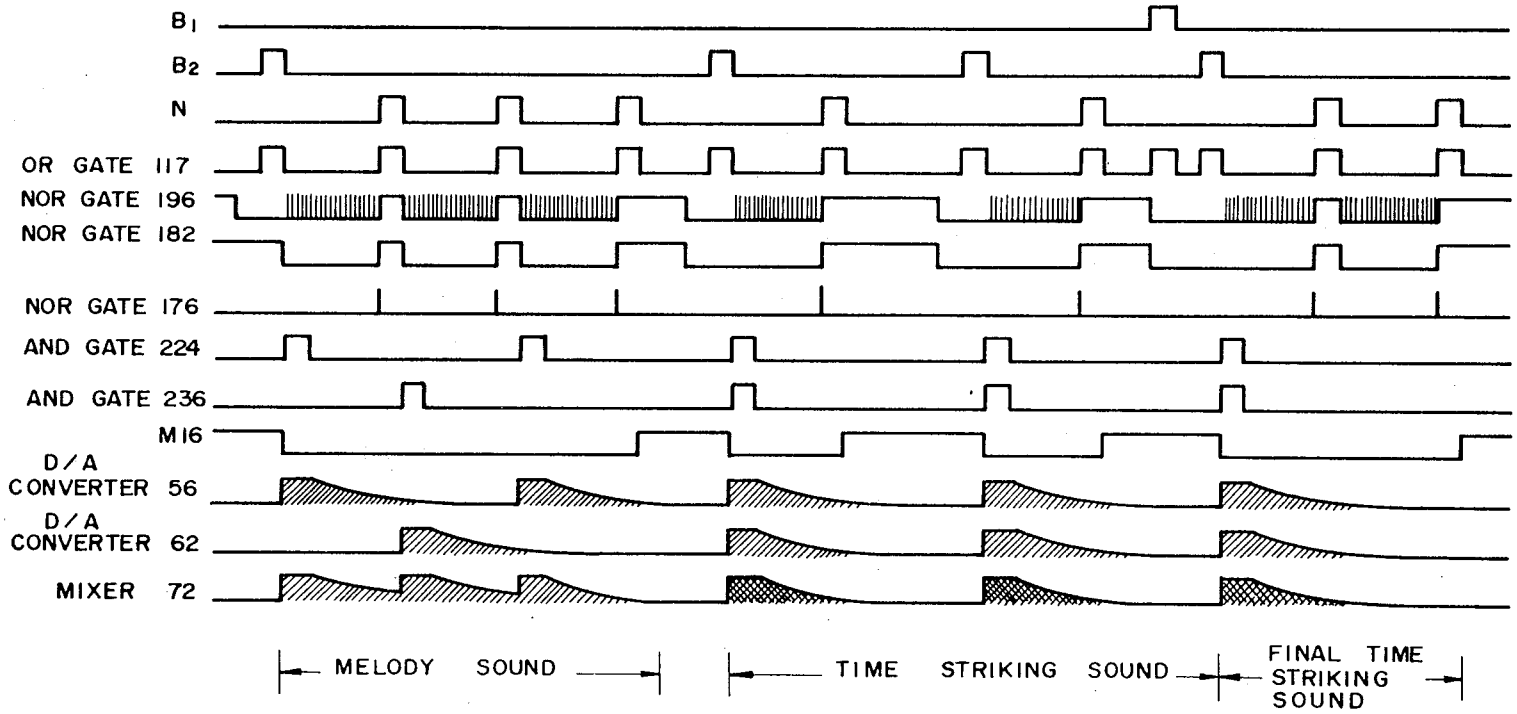

The description of the time signalling action at the indicating time of the right hour, 3:00 for example, in accordance with FIG. 12. The time signalling device of the present invention performs the melody sounds and the time striking sounds following after the melody sounds at the right hour.

In the time chart of FIG. 12, at the indicating time $t_6$ of the right hour, which is 3:00 hours, the same action as described in the above in accordance with FIG. 11, and the right hour detecting contact 68 is closed to provide the right hour signal E of the predetermined pulse width. Accordingly, the power saving circuit 36 starts to supply the power to each of the circuits. The melody sound production at the right hour is performed by the data direction of the ROM 32 in the same way as the time of "15 minutes" formarly described. The data of the ROM 32 directed at present time are characterized as the melody sound data accompanying the time striking commencement jump data. The melody sound production accompanying the time striking sound is performed in the same way as formarly described, and the necessary melody sound production is performed one after another. At the time of $t_6$ the AND gate 156 of the time signalling control circuit 40 supplies "H", but the output of the AND gate 154 is kept in "L" since the other input of the AND gate 154 is "L".

At the time of $t_7$ when the reading of the melody sound data corresponding to the right hour of the ROM 32 is completed, the time striking commencement jump data is read out of the ROM 32. When this ROM program signal M is supplied to the ROM memory decoder 132 of the time signalling contro circuit 40, the decoder 132 changes the $Q_2$ output into "H" and the $Q_3$ output into "L". Consequently, the AND gate 68, the AND gate 198 of the musical note length counter 70, and the AND gate group 170 are put in the gate OFF state, and the basic sound signal $P_3$ is not supplied from the oscillator 46 to the musical note length counter 70 and programmable dividers 48 and 50. From the one shot circuit 138 output is the "H" signal having the determined width, and the FF group 126 is put in the reset state. The output of the one shot circuit 138 is inverted at the inverter 142, and the AND gate 140 becomes "H" at the time of $t_8$ since the output of the inverter is "H" at the time of $t_8$ after the time of the pulse width determined by the one shot circuit 138 has elapsed. Accordingly, the gate ON signal is supplied from the AND gate 140 to the AND gate group 130 of the time signalling control circuit 40 by way of the one shot circuit 144, since all of the FF group are put in the reset state at this time, and at the FF group 130 written and established are the time striking commencement jump data of the ROM 32.

The "H" output of the AND gate 140 sets the FF 146 to output the time striking commencement signal C of "H" at its Q output. When the $\overline{Q}$ output is turned into "L", the AND gate 156 is put in the gate OFF state together with the AND gate group 122. Accordingly, the time signalling sound selecting signal is prevented from being supplied from the decoder 120 to the address counter 34. The "H" output of the AND gate 140 operates the one shot circuit 148, and the time striking reset signal W becomes "H" having the predetermined pulse width. Since the time striking signal W is converted by the inverter 150 to be input to the AND gate 152, the output of the AND gate 142 stays in "L", if the Q output of the FF 146 becomes "H". Accordingly, both of the AND gate groups 154 and 156 are put in the gate OFF state and the control program signal Y is not provided.

The above mentioned time striking commencement signal C supplies the gate ON signal to the AND gate group 88 of the time striking counter 38, and the time striking number signal determined by the time striking number detector 28 is written and established at the FF group 90. At the time of $t_8$ when the time striking numbers are written and established, the output of the NOR gate 104 turns into "L" and holds this established value continuously.

At the time of $t_9$ when it elapses the time of the pulse width of the one shot circuit 148 after the time of $t_8$ the time striking reset signal W becomes "L" and the AND gate 152 is put in the gate ON state by way of the inverter 150 so that the AND gate 154 is put in the gate ON state. At this time since the FF group 112 in the address counter 34 is put in the reset state by the time striking reset signal W, the control program hold signal Z of "H" is supplied from the address counter 34 to the time signalling control circuit 40. Accordingly, the AND gate 128 of the time signalling control circuit 40 is set in the gate ON state, and the data $M_4$ through $M_{12}$ in the time striking commencement jump data written into the above mentioned FF group 126 are written and established at the FF group 112 of the address counter 34 by way of the AND gate group 128 and the OR gate group 114. Since the control program hold signal Z is "L" at the time of $t_9$ by the establishment of the FF group 112 in the address counter 34, the new writing signal is not supplied to the address counter 34. It is understood that the "L" inversion of the above mentioned address reset signal M changes the reset signal J into "L", and that the reset state of the address counter 34 is released.

The ROM 32 makes the data $M_4$ through $M_{11}$ of the time striking commencement jump data written in this address counter 34 as the address directing signal and reads out the tempo data of the time striking sounds. Accordingly, in the same way as the above mentioned melody sound are read out, the $Q_2$ output of the ROM memory decoder 132 become "L" and the $Q_4$ output becomes "H". Consequently, the tempo data are written and established in the FF group 186 of the musical note length counter 70 and the address counter 34 is advanced by one step by the tempo set completion signal $B_2$ which is generated afterwards so that the musical note data of the time striking sound are output from the ROM 32. The contents of these musical note data are as follows:

signals $M_1$ through $M_3$=data showing the musical note length of the time striking sound signal $M_4$=operating signal of the envelope circuit 64 ($M_4$="H")

signal $M_5$=operating signal of the envelope circuit 66 ($M_5$="H")

signals $M_6$ and $M_8$ through $M_{11}$=data of the musical scale of one musical note of the time striking sounds and data of the octave (musical scale $G_2$ for example)

signals $M_7$ and $M_{12}$ through $M_{15}$=data of the musical scale of the other one musical note of the time striking sounds and data of the octave (musical scale of $C_3$ for example)

signal $M_{16}$=data discriminating that the data is the musical note data

The data $M_1$ through $M_3$ mentioned above are supplied to the musical note length counter 70 to establish the dividing ratio in order to count the musical note length at the FF group 172. The data $M_6$ and $M_8$ through $M_{11}$ are supplied to the programmable divider 48 and the data $M_7$ and $M_{12}$ through $M_{15}$ are supplied to the programmable divider 50 to establish the dividing ratio in order to produce the respective musical scales. At the same time, since the $Q_3$ output of the ROM memory decoder 132 becomes "H" and the $Q_4$ output becomes "L", the AND gate 68, the AND gate group 170 of the musical note length counter 70 and the AND gate 198 are put in the gate ON state and the basic sound signals $P_1$ and $P_3$ from the oscillator 46 are supplied to the programmable dividers 48 and 50 and the musical note length counter 70. Consequently, the musical note length counter 70 counts the length of the musical notes, and the programmable dividers 48 and 50 respectively output the required frequency signals. From the waveform ROM's 54 and 60 generated is the waveform digital signal repeatedly. At this time, furthermore, since the signals $M_{16}$ ("L"), $M_4$ ("H") and $M_5$ ("H") are input from the ROM 32 to the envelope circuits 64 and 66, both of the envelope circuits 64 and 66 are operated at the same time and the attenuating signals are supplied to the D/A converters 56 and 62. Consequently, the attenuated sounds of each musical scale waveform are output at the same time and supplied to the speaker 76 by way of the amplifier 75 after mixed at the mixer 72 so that the speaker 76 outputs the attenuated sounds of two different musical scale harmony.

When the first time striking sound completes its sounding, the musical note count up signal N is output to advance the address counter 34 by one step. The ROM 32 supplies the time striking cycle jump data as the ROM program signal M, and the ROM memory decoder 132 turns the $Q_3$ output into "L" and the $Q_5$ output into "H". The $Q_5$ output of "H" provides the time striking count up signal X from the one shot circuit 139 so that the AND gate 106 is set in the gate ON state to advance the FF group 90 of the time striking counter 38 by one step, since the time striking commencement signal C is "H" at the time of $t_{10}$, which is different from the time at $t_7$. At the same time, since the output of the OR gate 137 again becomes "H", the constant width of "H" signal is supplied from the one shot circuits 138, 144 and 148 to reset the address counter 34 and the data $M_4$ through $M_{12}$ are written at the FF 126. Afterwards, the data $M_4$ though $M_{12}$ are written and established at the address counter 34. The ROM 32 reads the time striking commencement jump data $M_4$ through $M_{12}$ and again turns the $Q_2$ output into "H" and the $Q_5$ output into "L". Consequently, the time striking sound data are again read out and the time striking operation is performed in the same way mentioned above.

As mentioned above, the continuous time striking sounds are generated and, at every time striking action, the FF group 90 of the time striking counter 38 repeats advancing until the struck number becomes one number smaller than the requested time striking numbers. In this state, when all of the FF group 90 of the time striking counter 38 are put in the set state by the time striking count up signal X, from the FF group 90 supplied are the final time striking commencement signals A ($A_1$ through $A_4$) of "H" to the time signalling control circuit 40, and "H" signal is output from the NOR gate 162. Consequently, the $\overline{Q}$ output of the FF 160 becomes "L" and the AND gate 136 is put in the gate OFF state. At this time the time striking commencement jump data is read out of the ROM 32 by the time striking cycle jump data, and the $Q_4$ output of the ROM memory decoder 132 turns into "H" and the $Q_5$ output turns into "H". As the AND gate 136 is in the gate OFF state, the data $M_4$ through $M_{12}$ of the time striking commencement jump data are not written into the address counter 34. The one shot circuit 166 is operated by turning the Q output of the FF 160 into "L" and the constant width of "H" is output to the final time striking count up signal $B_2$ to advance the address counter 34 by one step. Consequently, the final time striking tempo data are read out to establish the tinal time striking tempo at the FF group 186 of the musical note length counter 70. Afterwards, the tempo set completion signal $B_1$ advances the address counter 34 by one step to read the final time striking musical note data out of the ROM 32, and the waveforms are read out of the waveform ROM's 56 and 62 at the respective musical scale frequencies. Since both of the envelope control data $M_4$ and $M_5$ of these these final time striking musical note data are "H" and $M_{16}$ is "L", the envelope circuits 64 and 66 are operated and each of the D/A converters 62 and 56 outputs the different musical scale waveform. Accordingly, the speaker 76 generates the time striking sounds of two musical scale harmony.

Afterwards, the musical note count up signal N advances the address counter 34 by one step and the next final time striking musical note data are read out of the ROM 32. These musical note data are different at such point in comparison with the previous time striking musical note data that the envelope control data $M_4$ and $M_5$ are "L". Therefore, these final time striking musical note data count the length of the musical note and reads the waveforms out of the waveform ROM's 56 and 62. However, the waveforms are not output from the D/A converters 62 and 56, but the attenuated sounds only generated by the previous final time striking sound musical note data are output. When the musical note count up signal N advances the address counter 34 by one step, the ROM 32 reads the time signalling completion data out of the ROM 32 and the $Q_1$ output turns into "H". The FF 134 is, therefore, reset and the melody reset signal K is turned into "H". Consequently, the FF 116 of the address counter 34 is put in the reset state. All of the FF group 112 of the address counter 34 are also put in the reset state and the Q output D of the FF 116 is turned into "L". The output of the AND gate 156 of the time signalling control circuit 40 become "L" and the AND gate group 122 is put in the gate OFF state. Furthermore, the reset signal J resets the musical note length counter 70. At the time $t_{11}$, the NOR gate 176 outputs "H" signal instantaneously to operate the one shot circuit 178 and the one shot pulse is input to the address counter 34, but this can be disregarded since the FF group 112 is put in the reset state at this time. The reset state of the address counter 34 at the time $t_{11}$ makes the ROM program signal M be the reset data and the ROM memory decoder 132 of the time signalling control circuit 40 immediately inverted its output $Q_1$ into "L".

The time signalling completion signal S resets the power saving circuit 36 and the unnecessary electric power consumption can be prevented until the next time signalling time.

As mentioned above, the melody sounds and the time striking sounds at the right hour are produced.

As mentioned heretofore, according to the present invention, as each musical note signal of the melody sounds is alternatively output from the D/A converters 56 and 62 which are arranged after the envelope circuits 64 and 66, while the previously output musical note sound remains, the next musical note sound can be produced and the sounds can be generated similarly to the ones produced by the more mechanical time signalling means. According to the present invention, furthermore, since the combination of the data in the ROM 32 installed in the time signalling sound selecting circuit 40 can simplify the circuit composition performing the complicated and multi-functional time signalling action, and can perform the necessary time signalling action by optional selection such as selection of melody sounds and choosing the time striking sounds, it can be of wide use among various timepieces.

Incidentally, the time striking sounds are performed only at the right hour in the embodiment, but it is possible to produce at other requested times, "30 minutes" for example, one time of time striking sounds. In this case the time striking commencement jump data are added after the 30 minute melody sound data of the ROM, and further, one time of the time striking sound signal must be applied from the time striking number detector to the time striking counter 38.

In the embodiment, three different kinds of melody sounds are memorized in the ROM, but the numbers of memorized melody sounds can be optionally determined.

As described heretofore, according to the present invention, the time signalling sound can be obtained in the same signalling sound with the mechanical time signalling means in which the previously produced sound remains to mix with the next sound, and the time signalling sounds in accordance with the more mechanical time signalling means can be electronically produced with good quality by having musical scale signal outputting means which simultaneously provides two musical scale analog signals of the melody sounds with the basis of two kinds of musical data read out of the ROM, by composing in such a way that each of these two musical scale analog signals can be alternatively output from these musical scale signal outputting means, by attenuating each of the output musical note signals for longer while than the time when the next musical note is produced, and, for the time striking sounds, by simultaneously outputting these two musical scale analog signals to be mixed.

What is claimed is:

1. A device for a timepiece electronically signalling a time by melody sounds and time striking sounds comprising a musical scale ROM storing musical scale data for determining the usable scale of musical note, musical note length data for determining the type of musical scale and envelope trigger signals for controlling the operation of envelope for respective musical notes in predetermined melody sounds and time striking sounds, a signalling time detector electrically detecting prestablished signalling times, and address counter reading out a respective musical scale and respective musical note length data from said musical scale ROM one after another in accordance with the musical note rows which are the melody sounds and time striking sounds in response to the detecting signal of the signalling time detector, and a sound generator generating melody sounds or the time striking sounds with said musical scale and musical note length data which are read out by said address counters, wherein said sound generator comprises:

a musical note length counter determining a requested length of respective musical notes by means of selecting a counting interval of said musical note length counter coresponding to said musical note length data supplied from said musical scale ROM;

a pair of sound wave signal generating circuits respectively including a waveform ROM and a D/A convertor in order to output analog waveform signals in compliance with the musical scale set by said musical scale ROM;

a pair of envelope circuits triggered by said envelope trigger signals from said musical scale ROM and supplying to each of said sound wave signal generating circuits envelope signals which attenuate the waveform outputs from said pair of sound wave signal generating circuits in accordance with a predetermined attenuating characteristic;

a mixer mixing the signals from both of the sound wave signal generating circuits;

an amplifier and a speaker producing the requested melody sounds and the time striking sounds in response to a signal from the mixer; and said musical scale ROM storing musical scale data, musical note length data, envelope trigger signals for respective musical notes for alternately starting a pair of envelope circuits and same musical scale data of last musical note set for the respective musical notes of the requested melody sounds and for storing musical note length data, predetermined musical note data of two different kinds and envelope trigger signals for both of the envelope circuits respectively set for the time striking sounds, wherein for the melody sounds a pair of said envelope circuits are alternately started at every musical notes by said envelope trigger signals so that the musical notes in the requested musical scale can be generated with the requested musical note length, and, at the same time, the remaining envelope signal of the other envelope circuits is overlapped at least at the initial period, and for the time striking sounds both of the envelope circuits are started at the same time to overlap sound production of two different musical scale.

2. A time signalling device for a timepiece according to claim 1 wherein a power saving circuit is installed to supply operating power to each of said circuits only in time signalling operation.

3. A time signalling device for a timepiece according to claim 1 or 2 wherein a plurality of melody sound data corresponding to plural and different kinds of melodies are memorized in said ROM.

4. A time signalling device for a timepiece according to claim 3 wherein a plurality of melody sound data is optionally selected by means of selecting switch operated by a user.

5. A time signalling device for a timepiece according to claim 1 or 2 wherein said musical scale signal outputting means comprising:

an oscillator generating basic sound signal;

two programmable dividers dividing said basic sound signal at a dividing ratio determined by the musical scale data from said ROM;

two address counters counting the signals from each of said programmable dividers;

two waveform ROM's in which the waveforms are memorized in digital value and which output digital waveform signals on the basis of the counted value of said address counters; and two D/A converters converting the digital waveform signals from said waveform ROM's into analog waveform signals.

6. A time signalling device for a timepiece according to claim 5 wherein said sound generator includes an oscillator supplying basic sound signal, a programmable divider dividing said basic sound signal by the dividing ratio determined by ROM program signal of said ROM, and a musical note length counter determining the length of generated sounds by said ROM program signal of said ROM.

7. A time signalling device for a timepiece according to claim 1 or 2 wherein time signalling reset circuit is prepared in order to reset the time signalling action during the period of optionally determined.

* * * * *